US009266369B2

(12) United States Patent
Kageyama

(10) Patent No.: US 9,266,369 B2
(45) Date of Patent: Feb. 23, 2016

(54) INVERTIBLE INK STAMP HAVING AN INK TANK AND INK ABSORBER MEMBER

(71) Applicant: SHACHIHATA INC., Nagoya-shi, Aichi (JP)

(72) Inventor: Tomohiro Kageyama, Ichinomiya (JP)

(73) Assignee: SHACHIHATA INC., Aichi (JP)

( * ) Notice: Subject to any disclaimer, the term of this patent is extended or adjusted under 35 U.S.C. 154(b) by 50 days.

(21) Appl. No.: 13/912,795

(22) Filed: Jun. 7, 2013

(65) Prior Publication Data

US 2013/0327238 A1 Dec. 12, 2013

(30) Foreign Application Priority Data

Jun. 11, 2012 (JP) ..... 2012-132407
Jun. 11, 2012 (JP) ..... 2012-132408

(51) Int. Cl.

| | |
|---|---|
| ***B41K 1/40*** | (2006.01) |
| ***B41K 1/38*** | (2006.01) |
| ***B41K 1/02*** | (2006.01) |
| ***B41K 1/42*** | (2006.01) |
| ***B41K 1/52*** | (2006.01) |

(52) U.S. Cl.

CPC ... *B41K 1/38* (2013.01); *B41K 1/02* (2013.01); *B41K 1/40* (2013.01); *B41K 1/42* (2013.01); *B41K 1/52* (2013.01); *Y10T 29/49826* (2015.01)

(58) Field of Classification Search

CPC ..... B41K 1/02; B41K 1/38; B41K 1/40; B41K 1/42; B41K 1/52; B41K 1/54

USPC ..... 101/103, 104, 108, 327, 333, 334

See application file for complete search history.

(56) References Cited

U.S. PATENT DOCUMENTS

| | | | | |
|---|---|---|---|---|
| 3,376,812 | A * | 4/1968 | Sterling | 101/324 |
| 4,432,281 | A * | 2/1984 | Wall et al. | 101/334 |
| 4,852,489 | A | 8/1989 | Wall et al. | |

FOREIGN PATENT DOCUMENTS

| | | |
|---|---|---|
| JP | 41-19042 | 9/1966 |

OTHER PUBLICATIONS

Extended European Search Report dated Oct. 10, 2013, issued in corresponding European Patent Application No. 13171186.3.

* cited by examiner

*Primary Examiner* — Leslie J Evanisko

(74) *Attorney, Agent, or Firm* — Westerman, Hattori, Daniels & Adrian, LLP

(57) ABSTRACT

An invertible ink stamp comprises an ink absorber/retainer member disposed on top of the ink pad, an absorbent member disposed on the top of the ink absorber/retainer member and having capillary attraction weaker than that of the ink absorber/retainer member but sufficient to absorb excessive ink, the absorbent member having a vent in at least part of the top side or either of lateral sides for conducting to the atmospheric air, an ink tank having an ink supply tube that has its distal open end connected to the ink absorber/retainer member, and a wall member surrounding the whole circumferential surface of the ink absorber/retainer member for avoiding leakage of ink.

20 Claims, 26 Drawing Sheets

FIG.4
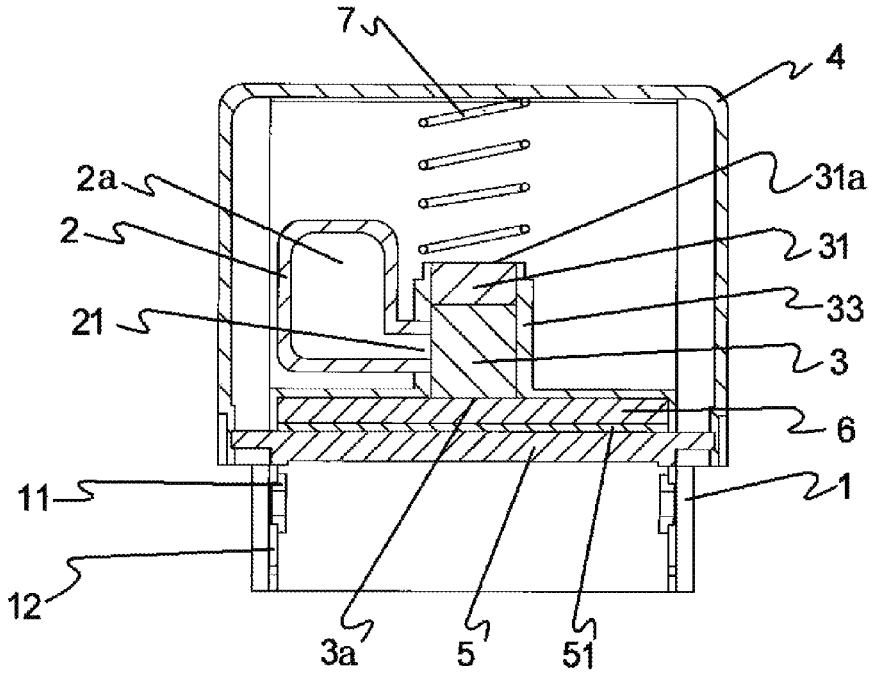
FIG.5A WAITING STATE
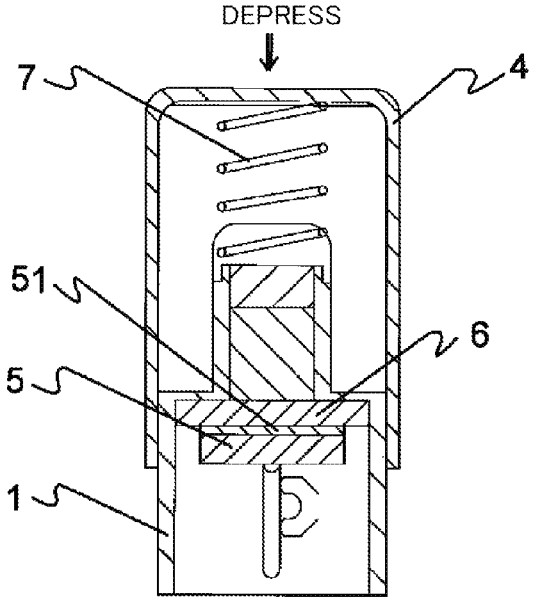
FIG.5B STAMPING STATE
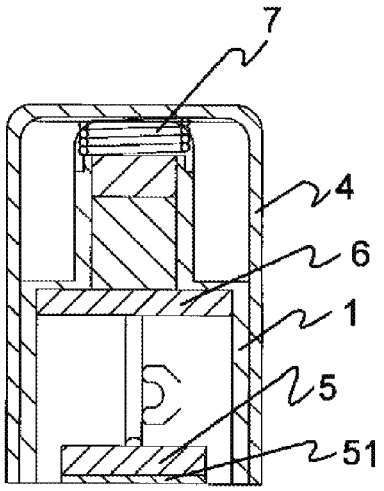

FIG.32A WAITING STATE
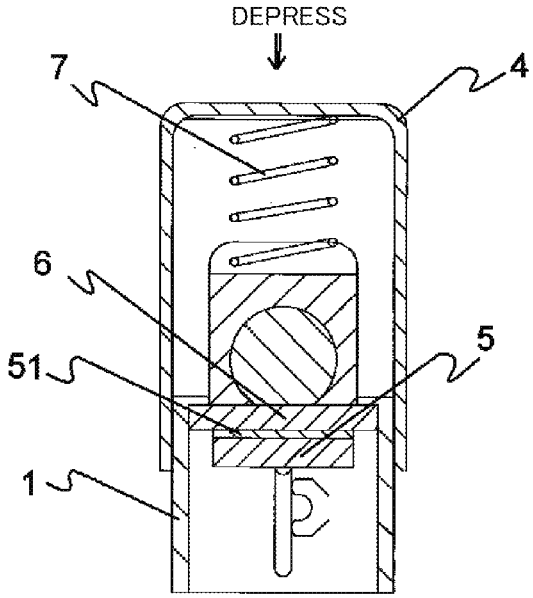
FIG.32B STAMPING STATE
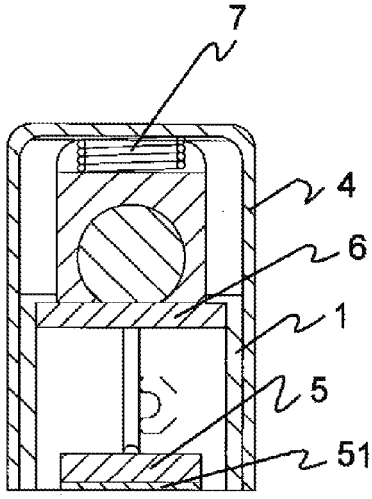
FIG.33
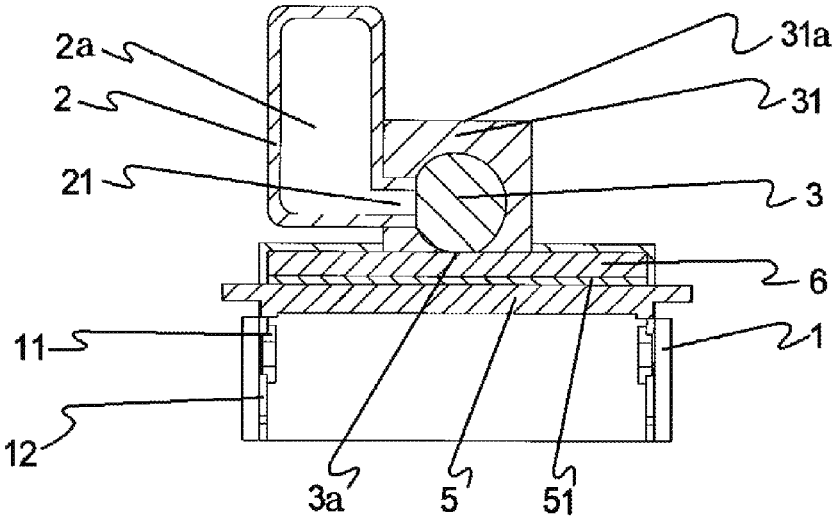

INVERTIBLE INK STAMP HAVING AN INK TANK AND INK ABSORBER MEMBER

CROSS-REFERENCE TO RELATED APPLICATIONS

The present patent application claims priority from Japan Application No. 2012-132407, filed Jun. 11, 2012 and from Japan Application No. 2012-132408, filed Jun. 11, 2012, which are incorporated herein by reference in their entirety.

FIELD OF THE INVENTION

The present invention relates to invertible ink stamps and manufacturing methods of the same, and more particularly, to ink stamp assemblies each of which not in use or on standby has its impressing face inverted or turned upward by an elastic member such as a spring so as to be in contact with a built-in ink pad, and each of which in use takes a compressed posture against the elastic member and has its impressing face reversed or turned downward to get ready for impressing mark on a surface, and manufacturing methods of the same.

In this specification, 'down/downward' is a gravitational direction while 'up/upward' is a reversal direction to the gravitational direction.

BACKGROUND OF THE INVENTION

In the prior art, invertible ink stamps of this sort not in use or on standby typically have their impressing faces retained in contact with an ink pad to supply the impressing faces with ink, and the invertible ink stamps in service have their impressing faces turned out to get ready for impressing mark on a surface. Repeatedly impressing results in ink impregnating the ink pad being used up, and the ink pad must be replenished with ink. The ink pad fitted in a stamp casing has to be first withdrawn and then impregnated with ink dripped from an external ink source. For that purpose, an appropriate amount of the replenishment ink must be known, or otherwise, an excessive amount of the liquid ink is likely to be applied. To shoot such a trouble, an improved version of the invertible ink stamps permits a user to supply ink to the ink pad through a pipe coupled to an ink impregnated member in an upper portion of the ink pad, as known in Patent Document 1, namely, Japanese Official Gazette of Preliminary Publication of Examined Utility Model S41-19042.

In the invertible ink stamp disclosed in Patent Document 1, the ink impregnated member is supplied with ink gradually through the pipe until it is completely filled up to the maximum capacity. After that, the pipe has its inlet closed to get ready for impressing work, but a rapid temperature rise and the resultant rapid increase in the internal pressure of the pipe is prone to cause an overflow of ink from the ink impregnated member to such an extent that the ink drips from the ink stamp.

SUMMARY OF THE INVENTION

The present invention has been made to overcome the aforementioned disadvantage of the prior art inventions, and in a first aspect of the present invention, an invertible ink stamp comprises an inner casing provided with inversion guides inside, an outer casing attached to the inner casing with an elastic element interposed therebetween, a primary ink stamp member having an ink stamp face and invertible by virtue of the inversion guides, an ink pad disposed within the inner casing, an ink absorber/retainer member disposed on top of the ink pad, an absorbent member disposed on the top surface of the ink absorber/retainer member and having capillary attraction weaker than that of the ink absorber/retainer member but sufficient to absorb excessive ink, the absorbent member having a vent in at least part of the top side or either of lateral sides for conducting to the atmospheric air, an ink tank having an ink supply tube that has its distal open end connected to the ink absorber/retainer member, and a wall member surrounding the whole circumferential surface of the ink absorber/retainer member and covering the bottom surface of the ink absorber/retainer member, the wall member having an ink outlet at the bottom.

In a second aspect of the present invention, the wall member is a ink-blocking wall member, and the bottom of the wall member is in contact with an upper major surface of the ink pad.

In a third aspect of the present invention, the wall member may be a fiber wall member or a porous wall member weaker in capillary attraction than the ink absorber/retainer member and having air conductivity, and the fiber wall member or the porous wall member has its bottom surface in contact with the upper major surface of the ink pad.

In a fourth aspect of the present invention, the ink supply tube is disposed on either of lateral sides of the ink absorber/retainer member, and the ink supply tube has its distal open end coupled to the ink absorber/retainer member on the side.

In a fifth aspect of the present invention, the ink supply tube is disposed on either of lateral sides of the ink absorber/retainer member, and the ink supply tube has its distal open end coupled to an inner portion of the ink absorber/retainer member.

In a sixth aspect of the present invention, the ink supply tube is disposed on either of lateral sides of the ink absorber/retainer member, and the ink supply tube has its distal open end coupled to the ink absorber/retainer member on the top.

In a seventh aspect of the present invention, the ink supply tube is disposed on top of the ink absorber/retainer member, and the ink supply tube has its distal open end coupled to an inner portion of the ink absorber/retainer member.

In an eighth aspect of the present invention, the ink supply tube is singular or plural in number.

In a ninth aspect of the present invention, the ink tank has an orifice in an upper major surface, a refill ink cartridge containing ink has an open end, and the refill ink cartridge is attached to the ink tank by detachably fitting the open end in the orifice for a hermetical seal.

In a tenth aspect of the present invention, a plug is put in the open end of the refill ink cartridge, and the open end is unplugged when the open end is fitted in the orifice of the ink tank.

In an eleventh aspect of the present invention, a plug is put in the open end of the refill ink cartridge, and the open end is plugged when the open end is removed from the orifice of the ink tank.

In a twelfth aspect of the present invention, a method of manufacturing the invertible ink stamp in the first aspect of the present invention comprises press fitting the distal open end of the ink supply tube in the absorbent member for converting it to intrinsic use as the ink absorber/retainer member in the vicinity of the distal open end of the ink supply tube, and the wall member is formed of the absorbent member.

In a thirteenth aspect of the present invention, the ink supply tube has its distal open end press fitted in the absorbent member on either of lateral sides, so that the ink supply tube is disposed on the side of the ink absorber/retainer member and that the distal open end of the ink supply tube is coupled to the ink absorber/retainer member on the side.

In a fourteenth aspect of the present invention, the ink supply tube has its distal open end press fitted in the absorbent member on either of lateral sides, so that the ink supply tube is disposed on the side of the ink absorber/retainer member and that the distal open end of the ink supply tube is coupled with the inner portion of the ink absorber/retainer member.

In a fifteenth aspect of the preset invention, the ink supply tube has its distal open end press fitted in the absorbent member on top, so that the ink supply tube is disposed on top of the ink absorber/retainer member and that the distal open end of the ink supply tube is coupled to the ink absorber/retainer member on top.

In a sixteen aspect of the present invention, the ink supply tube has its distal open end press fitted in the absorbent member on top, so that the ink supply tube is disposed on top of the ink absorber/retainer member and that the distal open end of the ink supply tube is coupled with the inner portion of the ink absorber/retainer member.

In a seventeenth aspect of the present invention, the ink supply tube is singular or plural in number.

In an eighteenth aspect of the present invention, the ink tank has an orifice in an upper major surface, a refill ink cartridge containing ink has an open end, and the refill ink cartridge is attached to the ink tank by detachably fitting the open end in the orifice for a hermetical seal.

In a nineteenth aspect of the present invention, a plug is put in the open end of the refill ink cartridge, and the open end is unplugged when the open end is fitted in the orifice of the ink tank.

In a twentieth aspect of the present invention, a plug is put in the open end of the refill ink cartridge, and the open end is plugged when the open end is removed from the orifice of the ink tank.

In the first aspect of the present invention, since the ink absorber/retainer member is overlain by the absorbent member weaker in capillary attraction than the ink absorber/retainer member so that the ink absorber/retainer member takes precedence of absorbing ink over the absorbent member, a rapid temperature rise and the resultant rise of the internal pressure within the ink tank could let ink move into the absorbent member but would not cause an overflow of ink from the ink pad.

In the second aspect of the present invention, since the wall member surrounding the ink absorber/retainer member is a ink-blocking wall member, an increase of the internal pressure inside the ink tank could let ink move into the absorbent member but would not cause an overflow of ink from the ink pad, similar to the first aspect of the invention.

In the third aspect of the present invention, since the wall member surrounding the ink absorber/retainer member is a fiber wall member or a porous wall member weaker in capillary attraction than the ink absorber/retainer member and having air conductivity, an increase of the internal pressure inside the ink tank could let ink move not only into the absorbent member but also into the fiber wall member or the porous wall member, and it would not cause an overflow of ink from the ink pad, similar to the previous aspects of the invention.

In the fourth and thirteenth aspects of the present invention, since the ink supply tube is disposed on the side of the ink absorber/retainer member, and the ink supply tube has its distal open end coupled to the ink absorber/retainer member on the side, the ink absorber/retainer member can be impregnated with ink without difficulty.

In the fifth and fourteenth aspects of the present invention, since the ink supply tube is disposed on the side of the ink absorber/retainer member, and the ink supply tube has its distal open end coupled to an inner portion of the ink absorber/retainer member, the ink absorber/retainer member can be impregnated with ink without difficulty, and a more secure connection of the distal open end of the ink supply tube with the ink absorber/retainer member can be obtained.

In the sixth and fifteenth aspects of the present invention, since the ink supply tube is disposed on the side of the ink absorber/retainer member, and the ink supply tube has its distal open end coupled to the ink absorber/retainer member on the top, the ink absorber/retainer member can be impregnated with ink without difficulty.

In the seventh and sixteenth aspects of the present invention, since the ink supply tube is disposed on top of the ink absorber/retainer member, and the ink supply tube has its distal open end coupled to an inner portion of the ink absorber/retainer member, the ink absorber/retainer member can be impregnated with ink without difficulty, and a more secure connection of the distal open end of the ink supply tube with the ink absorber/retainer member can be obtained.

In the eighth and seventeenth aspects of the present invention, since the ink supply tube may be either singular or plural in number, the invention becomes more useful in putting it into practical use.

In the ninth and eighteenth aspects of the present invention, when the ink tank becomes empty and has to be replenished with ink, merely the current refill ink cartridge attached to the ink tank may be replaced with new one. The ink supply tube, the ink absorber/retainer member, and their joint portion do not have to be replaced each time, and once assembled, the components serve for long and stable supply with ink without trouble of ink leakage.

In the tenth and nineteenth aspects of the present invention, since the open end of the refill ink cartridge is unplugged when the open end is fitted in the orifice of the ink tank, leakage of ink can be avoided during the replacement of the refill ink cartridge, and the replacement work is facilitated.

In the eleventh and twentieth aspects of the present invention, by virtue of a valve device where an opener plunger is used to press the plug and open a valve so as to unplug the refill ink cartridge, the refill ink cartridge is plugged by the valve during replacing it with new one, and the remnant ink in the current cartridge would not leak out.

In the twelfth aspect of the present invention, since the ink absorber/retainer member is overlain by the absorbent member weaker in capillary attraction than the ink absorber/retainer member so that the ink absorber/retainer member takes precedence of absorbing ink over the absorbent member, a rapid temperature rise and the resultant rise of the internal pressure within the ink tank could let ink move into the absorbent member but would not cause an overflow of ink from the ink pad.

Since the ink supply tube has its distal open end press fitted in the absorbent member to convert the absorbent member to intrinsic use as the ink absorber/retainer member greater in capillary attraction in the vicinity of the ink supply tube, the ink absorber/retainer member is not needed in an initial assembling stage, and the invention becomes more useful in putting it into practical use. Although connecting the ink supply tube with the ink absorber/retainer member is an essential step of the invention, another step of connecting with the absorbent member can efficiently and advantageously serve as such an essential step.

BRIEF DESCRIPTION OF THE DRAWINGS

FIG. 4 is a sectional view showing the first embodiment, taken along the line A-A of FIG. 1;

FIGS. 5A and 5B are sectional views taken along line B-B of FIG. 1 showing the first embodiment in use, (the first embodiment on standby in FIG. 5A and the first embodiment during impressing mark in FIG. 5B);

FIGS. 32A and 32B are sectional views taken along line B-B of FIG. 1 showing the twelfth embodiment in use, (the first embodiment on standby in FIG. 5A and the first embodiment during impressing mark in FIG. 5B);

FIG. 33 is a diagram showing a thirteenth embodiment of the present invention;

BEST MODE OF THE INVENTION

Figure 1:
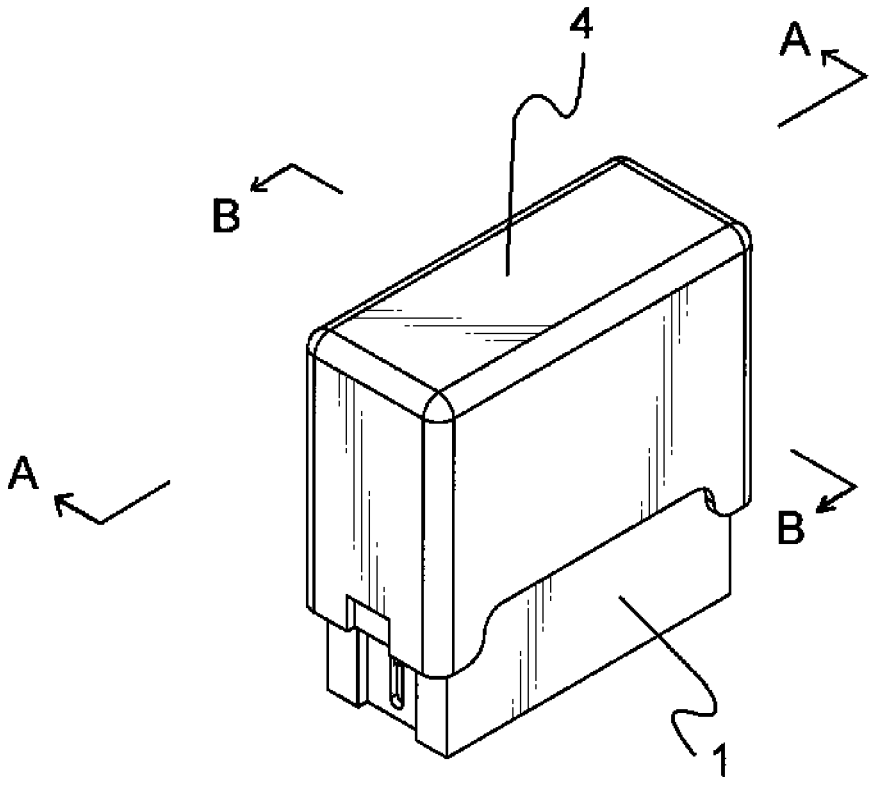
FIG. 1 is a perspective view showing first and twelfth embodiments of the present invention.
Figure 2:
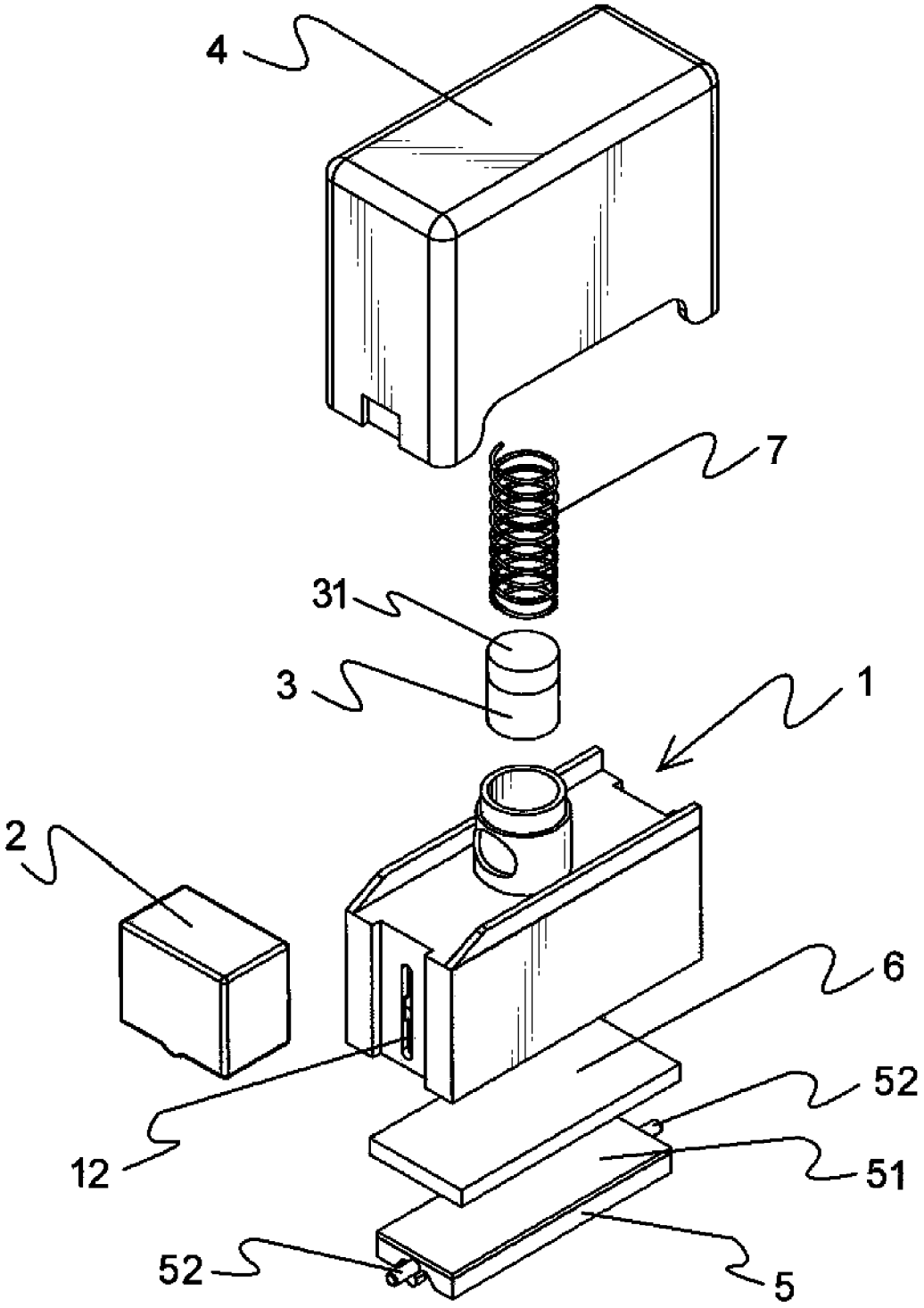
FIG. 2 is a top perspective exploded view showing the first and twelfth embodiments.
Figure 3:
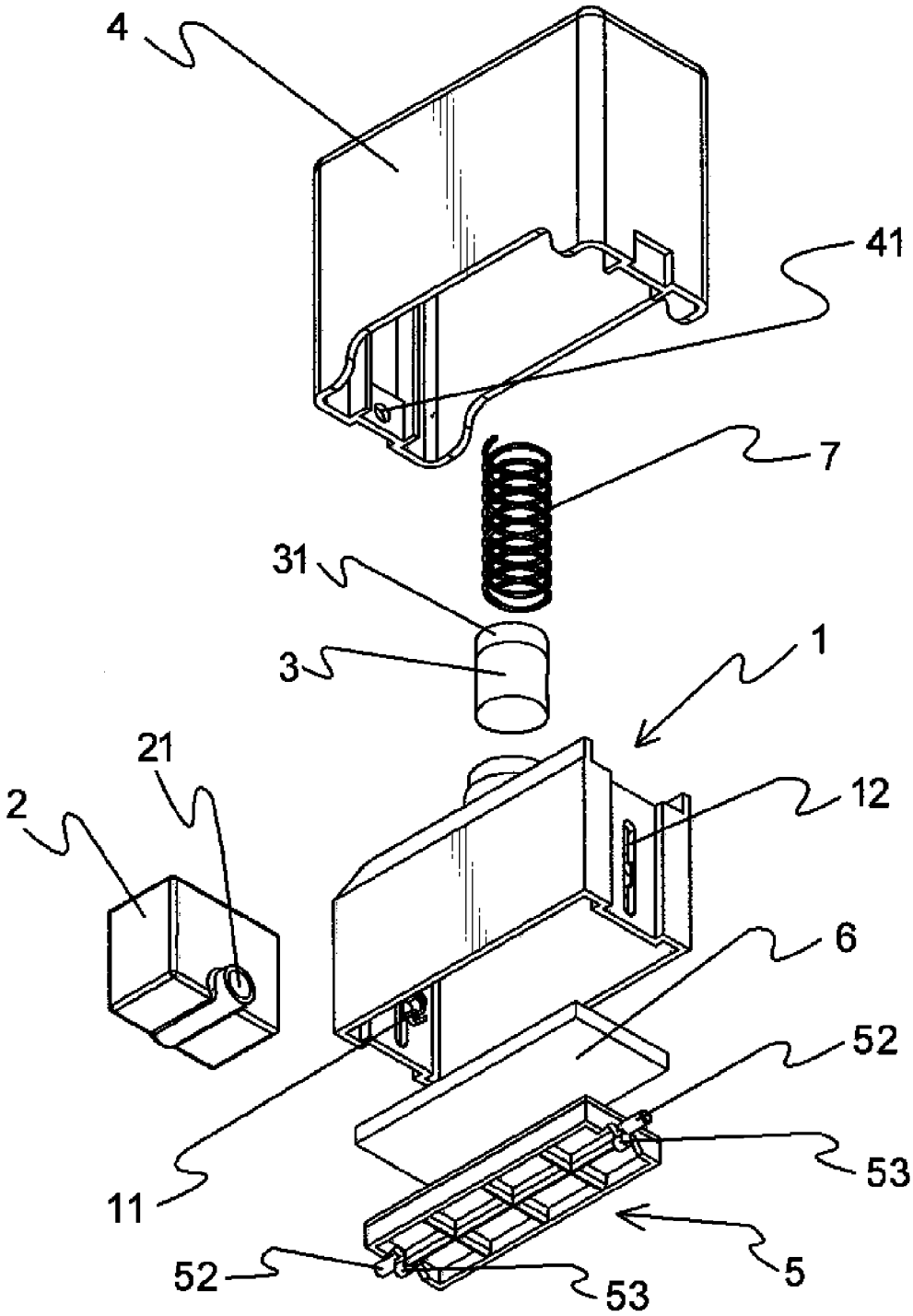
FIG. 3 is a bottom perspective exploded view showing the first and twelfth embodiments.

One preferred embodiment of the present invention will be described in detail with reference to FIGS. 1 to 5.

An inner casing 1 is a box-shaped member of which bottom side is an open end and lateral narrow sides have their respective slits 12 cut out vertically so as to permit a fixed axle 52 for a primary ink stamp member 5 to laterally extend through both the slits 12 and slide along them, and the primary ink stamp member 5 detailed later can be inverted by means of inversion guides 11 provided inside the inner casing 1 in the vicinity of the slits 12.

An outer casing 4 is also a box-shaped member of which bottom side is an open end and lateral narrow sides have their respective inside mounting apertures 41 to fit on the fixed axle 52 for the primary ink stamp member 5.

An ink pad 6 is disposed on the ceiling inside the inner casing 1. There are various ways available to put the ink pad inside the inner casing 1; for instance, ribs provided in the ceiling for directly holding the ink pad 6 therebetween, an adhesive suitable for bonding the ink pad 6 to the ceiling, an ink cartridge housing the ink pad 6 and meshed with the ceiling, and so forth. The ink pad 6 is made of a porous material such as sponge, felt, or the like that can be impregnated with ink.

The primary ink stamp member 5 has an ink stamp face 51 on one of its major surfaces. The ink stamp face 51 is not made of ink permeable material but of ink transferable material.

The primary ink stamp member 5 has the fixed axle 52 in its laterally opposite sides so as to fit it in the mounting apertures 41 inside the outer casing 4 and slide through along the slits 12 in the inner casing 1, and it also has an inversion shaft 53 with its opposite ends engaged with the inversion guides 11 for stably inverting the primary ink stamp member 5.

An ink absorber/retainer member 3 is located in an upper major surface of the ink pad 6.

The ink absorber/retainer member 3 may be made of any material having micropores; for instance, resin impregnated/coated fiber bundle, thermally fused fiber bundle, felted material, needle punched felt, porous materials such as porous foamed synthetic resin, extruded synthetic resin molding with axial ink guide channels, or the like. Such materials may be made of any of synthetic resin fibers such as acrylic fiber, polyester fiber, and the like.

Part or all of a lower major surface of the ink absorber/retainer member 3 is left open to serve as an ink outlet 3*a*. The ink pad 6 and the ink outlet 3*a* in the ink absorber/retainer member 3 are contiguous to each other. A capillary attraction effect working between the ink pad 6 and the ink absorber/retainer member 3 can be adjusted so as to apply an appropriate amount of ink to the ink pad 6.

An absorbent member 31 weaker in capillary attraction than the ink absorber/retainer member 3 is located in the upper major surface of the ink retainer 3. The absorbent member 31 may be made of any material with micropores; for instance, resin impregnated/coated fiber bundle, thermally fused fiber bundle, felted material, needle punched felt, porous materials such as porous foamed synthetic resin, extruded synthetic resin molding with axial ink guide channels, or the like. Such materials may be made of any of synthetic resin fibers such as acrylic fiber, polyester fiber, and the like.

The capillary attraction is a capability of capillary rise, and in this invention, it refers to a capability of inducing ink to flow through the micropores. Since the absorbent member 31 has a weaker capillary attraction compared with the ink absorber/retainer member 3, ink in the latter is hard to flow to the former.

Part or all of an outer surface of the absorbent member 31 is left open to serve as an air vent 31*a* conductive to the external atmosphere so as to allow air to pass out of or into the absorbent member 31.

Alternatively, the ink absorber/retainer member 3 and the absorbent member 31 may be integrated with each other in a unit. For that purpose, an amount of the fibers may be adjusted to vary from one part to another during manufacturing the ink absorber/retainer member 3, or otherwise, with a throughout unvaried amount of the fibers, a volume of the ink absorber/retainer member 3 may be partially reduced. The latter method of partially reducing the volume of the ink absorber/retainer member 3 includes, for example, pressing part of the outer circumferential surface of the ink absorber/retainer member 3 and compressing it inward in radial directions to shape the ink absorber/retainer member 3, pressing the same on its bottom end upward and compressing it, and so on.

The ink absorber/retainer member 3 and the absorbent member 31 have their respective sides enclosed with a wall member. The wall member prevents ink impregnating the ink absorber/retainer member 3 from leaking out of the sides. The present invention employs the wall member made of any of fiber materials, porous materials, ink-blocking wall materials, and the like.

A fiber wall member 32 may be weaker in capillary attraction compared with the material of the ink absorber/retainer member 3. The fiber wall member 32 allows air to pass into and out and has its bottom surface in contact with the upper major surface of the ink pad 6. The fiber wall member 32 has a weaker capillary attraction than the ink absorber/retainer member 3 so as to make it hard to move the ink to the fiber wall member 32.

The fiber wall member 32 may be made of any material having micropores; for instance, resin impregnated/coated fiber bundle, thermally fused fiber bundle, felted material, needle punched felt, porous materials such as porous foamed synthetic resin, extruded synthetic resin molding with axial ink guide channels, or the like. Such materials may be made of any of synthetic resin fibers such as acrylic fiber, polyester fiber, and the like. The fiber wall member 32 may be made of the same substance as that of the absorbent member 31 but does not have to be.

The fiber wall member 32 may have its outer circumferential surface coated with synthetic resin film or the like.

The fiber wall member 32 may be replaced with a wall member made of any of porous materials. The porous materials referred to herein include thermoplastic resins, thermoset resins, rubber, glass, ceramics, metals, and the like each of which is foamed by any well-known means to have contiguous foams but has a reduced capillary attraction compared with the ink absorber/retainer member 3.

The wall member may be replaced with an ink-blocking wall member 33. The ink-blocking wall member 33 may be made of any of materials that can block ink, including resins such as plastic, resin film, metals, and so forth.

An ink tank 2 has an open-ended ink supply tube 21 in a bottom major surface, and the ink supply tube 21 extends along the full width of the bottom major surface. Ink fills an inside tank space 2*a*.

The ink supply tube 21 may be single in number, or alternatively, it may be two or more, as in an eighth modified embodiment described with reference to FIGS. 15 to 24.

A manner with a single ink supply tube will first be discussed. A cross section taken along outer and inner circumferences of the ink supply tube 21 may be in any shape of a circle, an ellipse, and polygons such as a triangle, a rectangle, and the like. An open end of the ink supply tube 21 may be directed downward, or otherwise, laterally outward. The distal open end of the ink supply tube 21 may take any of various shapes, including a bevel, a steep or orthogonal surface, a conically curved surface, a convexly curved surface, and so forth.

Next, another manner in which there are two or more of the ink supply tubes will be discussed. A cross section taken along outer and inner circumferences of each of the ink supply tubes 21 may be in any shape of a circle, an ellipse, and polygons such as a triangle, a rectangle, and the like. A distal open end of each of the ink supply tubes 21 may be directed downward, or otherwise, laterally outward. The distal open end of each of the ink supply tubes 21 may take any of various shapes, including a bevel, a steep or orthogonal surface, a conically curved surface, a convexly curved surface, and so forth.

Figure 16:
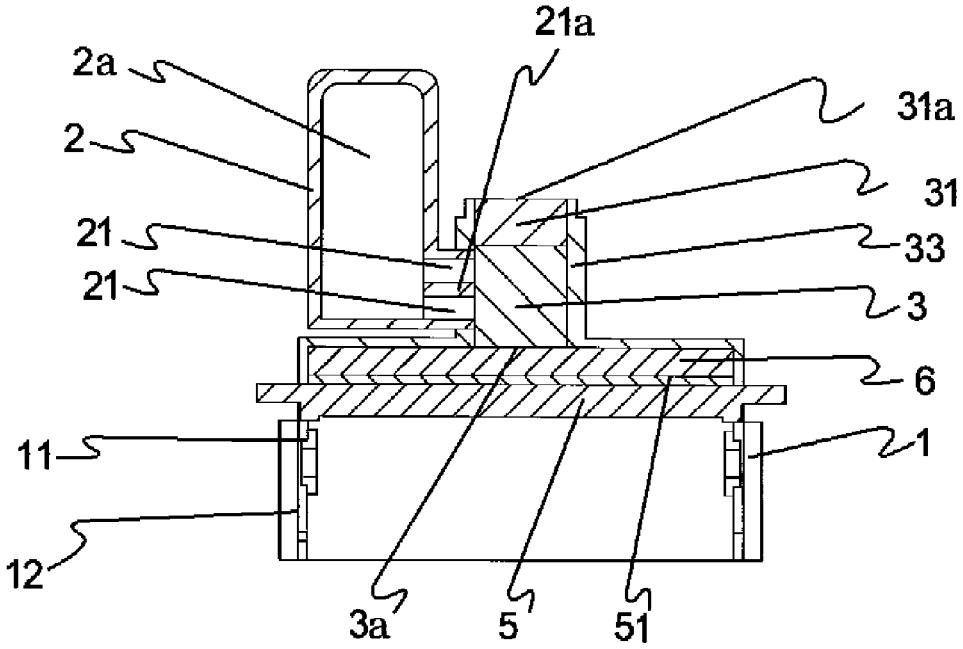
FIG. 16 is a diagram showing an alternative ink supply tube in the eighth embodiment.

As shown in FIG. 16, the ink supply tubes 21 may have their respective circumferential walls coupled to each other. Such a manner is just the same as a single tube separated by an axially extended partition wall 21*a* into side-by-side ducts which serves as two independent ink supply tubes 21 in parallel with each other inside the single tube.

Figure 17:
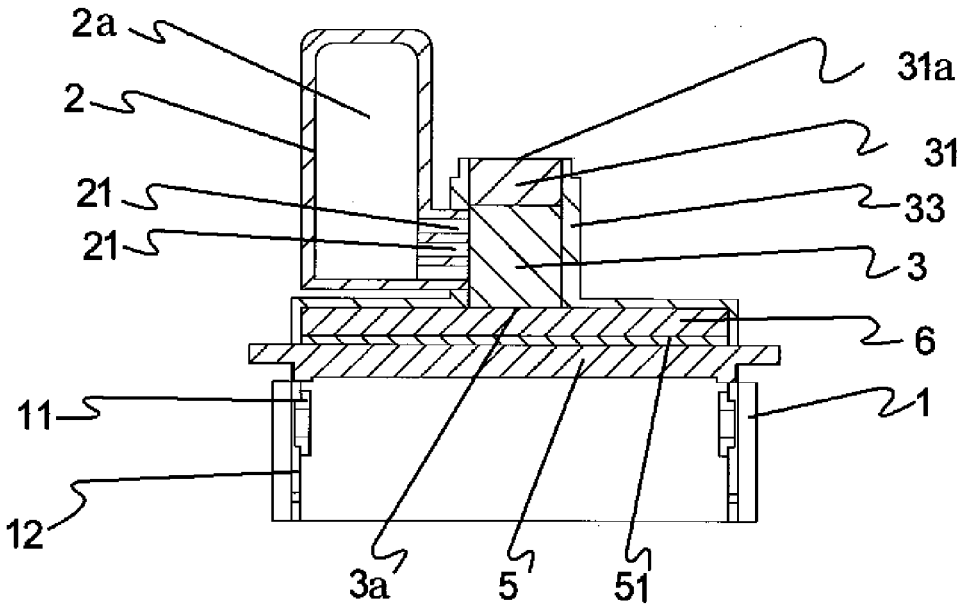
FIG. 17 is a diagram showing another alternative of the ink supply tube in the eighth embodiment.
Figure 18:
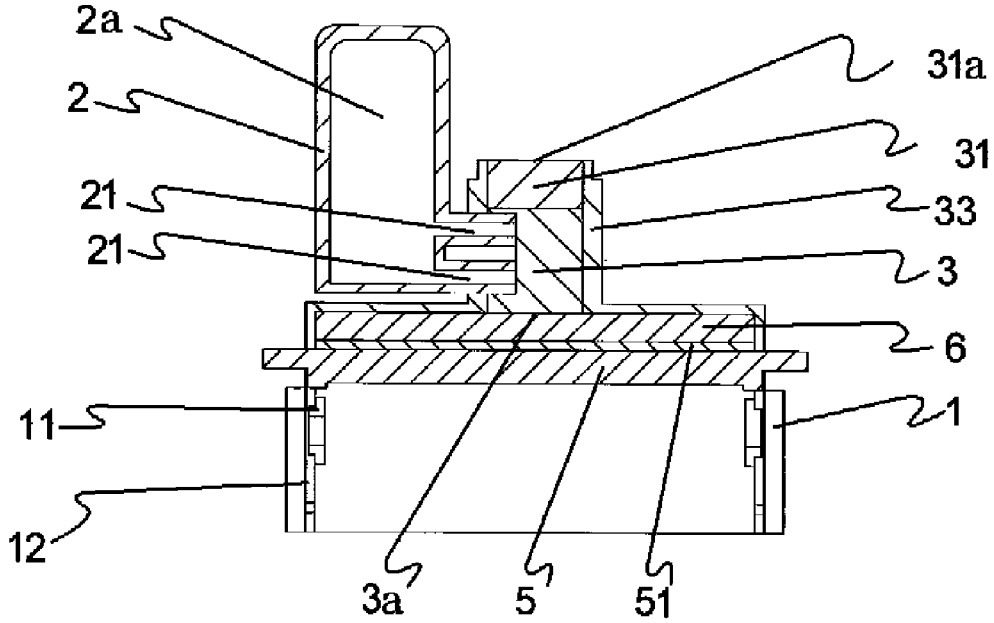
FIG. 18 is a diagram showing the eighth embodiment.
Figure 19:
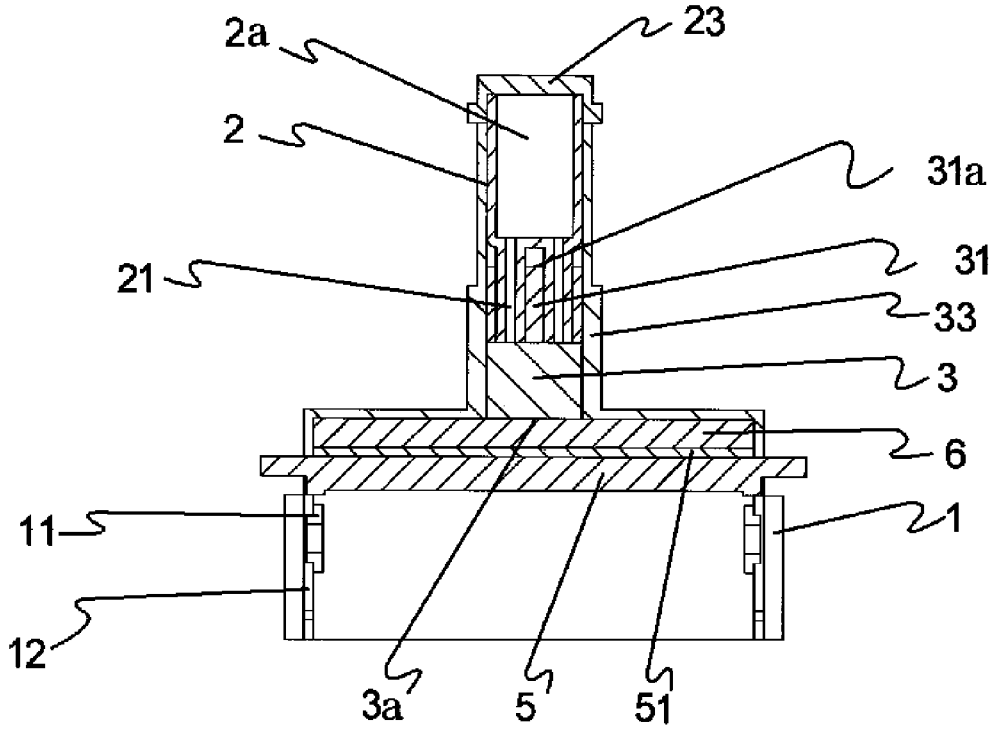
FIG. 19 is a diagram showing the eighth embodiment.
Figure 20:
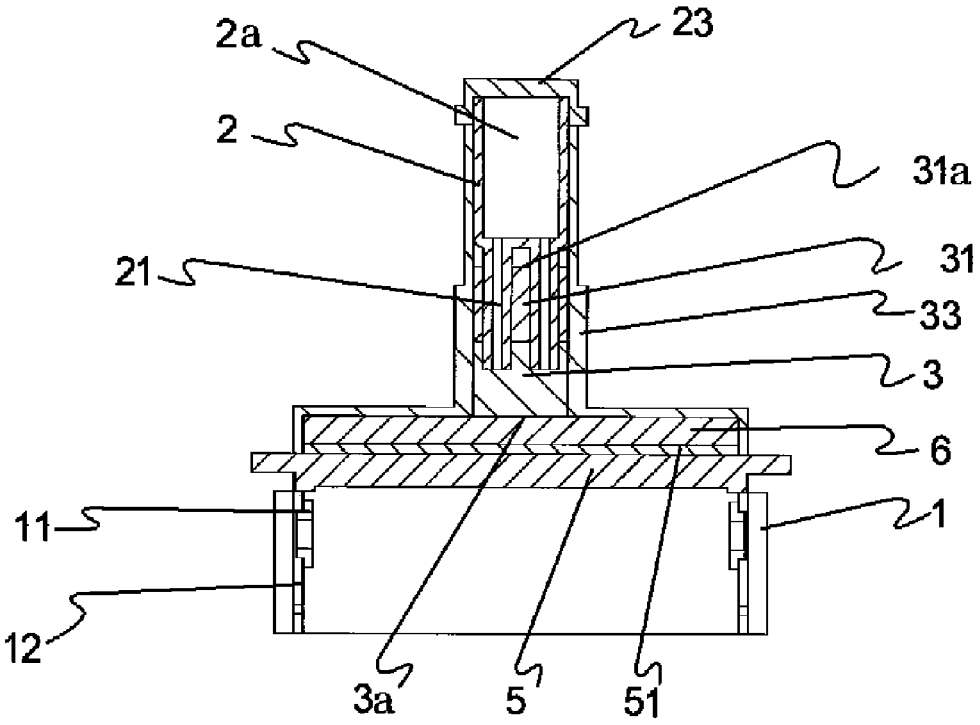
FIG. 20 is a diagram showing the eighth embodiment.
Figure 21:
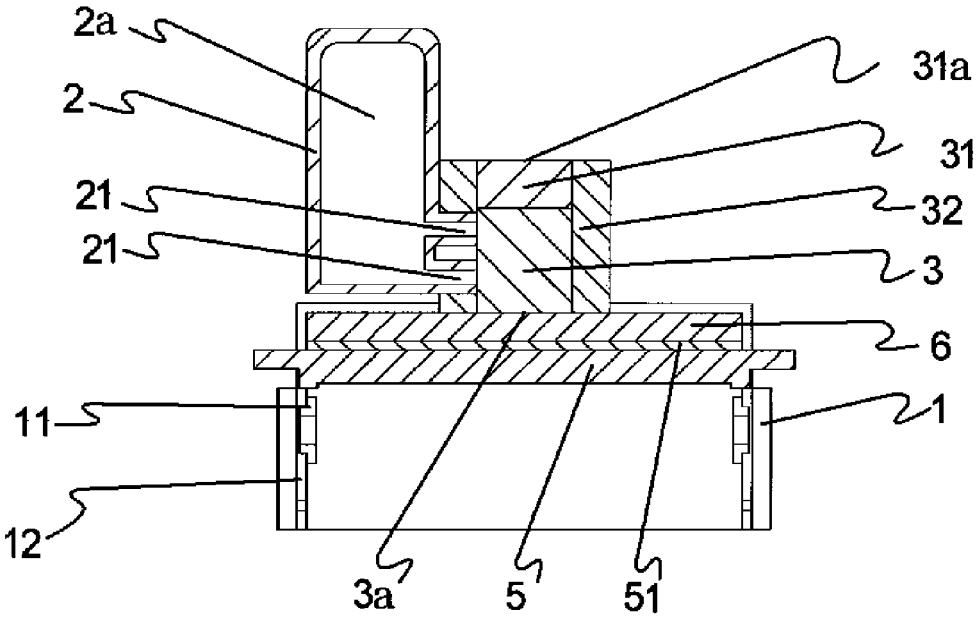
FIG. 21 is a diagram showing the eighth embodiment.
Figure 22:
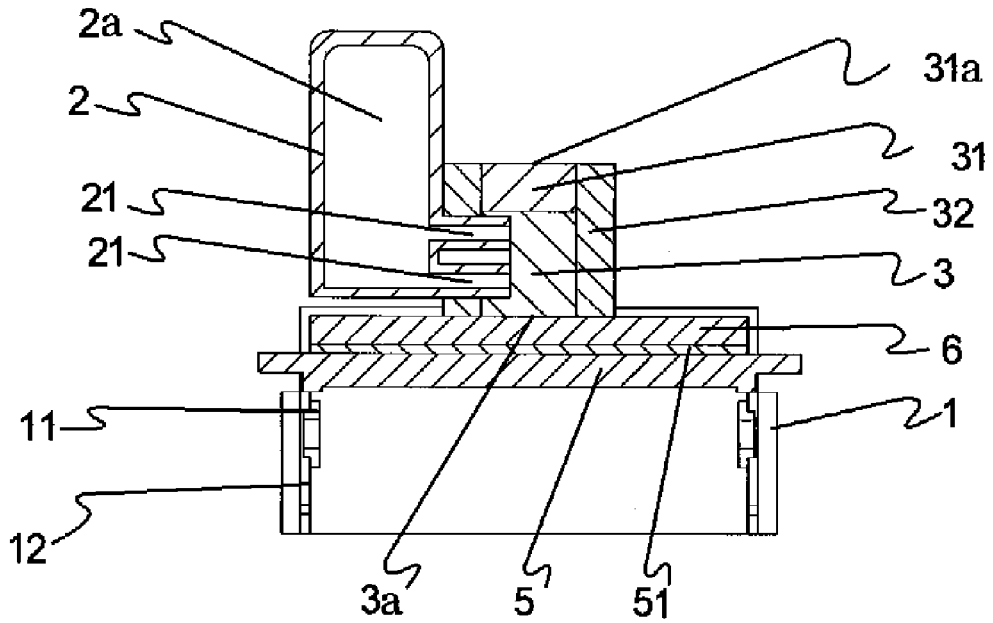
FIG. 22 is a diagram showing the eighth embodiment.
Figure 23:
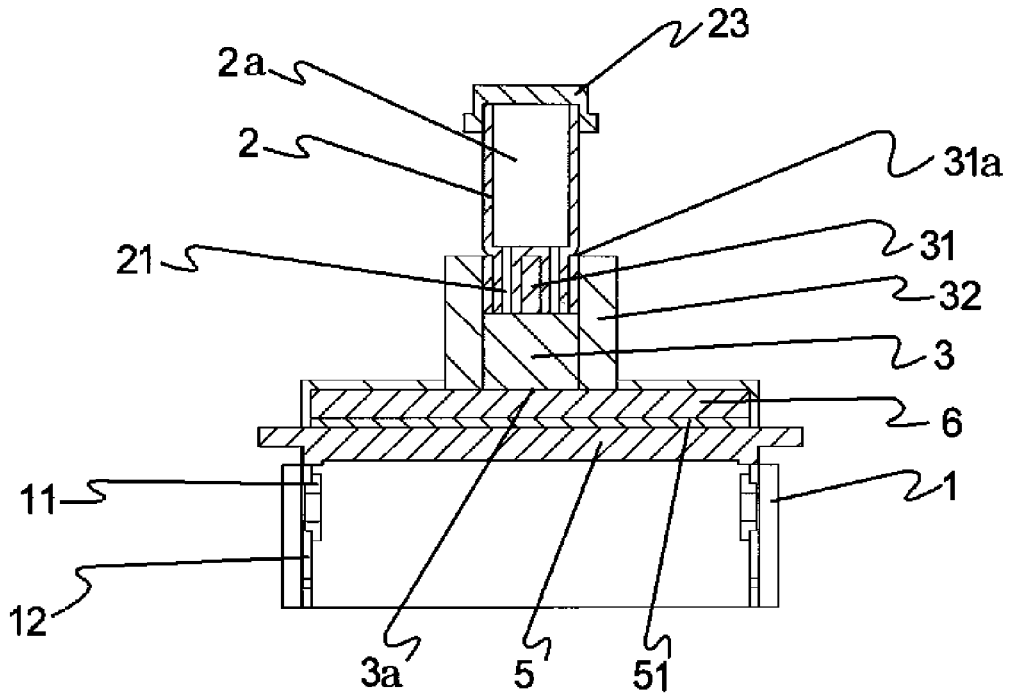
FIG. 23 is a diagram showing the eighth embodiment.
Figure 24:
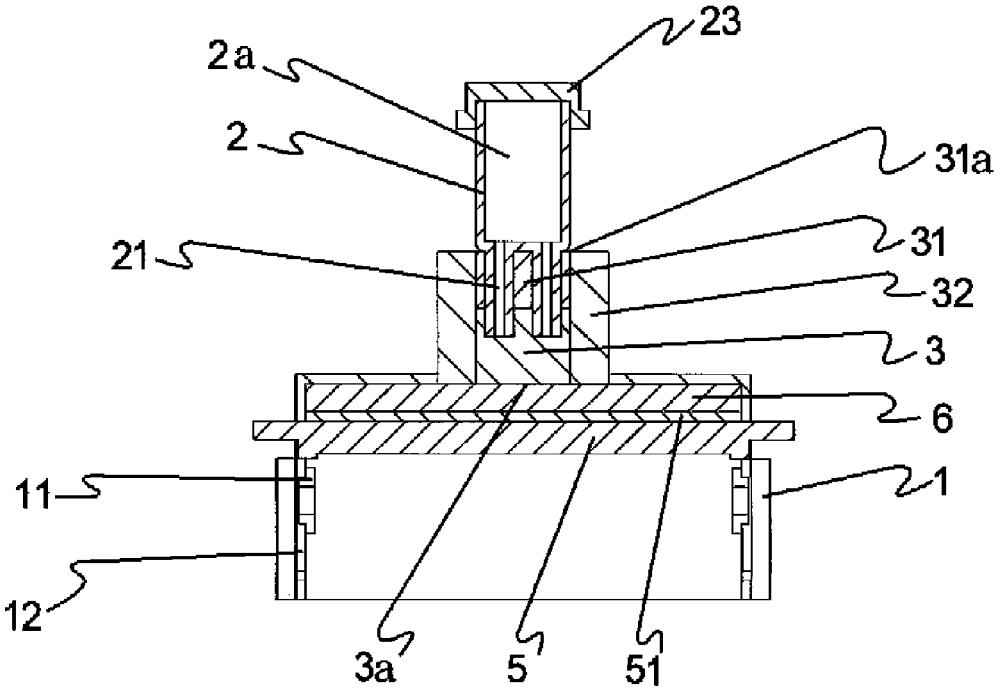
FIG. 24 is a diagram showing the eighth embodiment.

As can be seen in FIG. 17, two of the ink supply tubes 21 may be disposed so that one smaller in diameter may be located within the other larger in diameter. In such a manner, an inner circumferential surface of the larger ink supply tube 21 together with an outer circumferential surface of the smaller ink supply tube 21 define a channel having an annular cross section, and the smaller ink supply tube 21 provides an inner channel having a circular cross section.

The ink tank 2 is integrally molded with the ink supply tube 21. Various ways of integral molding may be used, including a method of shaping the ink supply tube 21 in the previously molded ink tank 2 by means of injection molding, pouring ink in the molding, and then thermally sealing an ink pouring end, and a method of shaping all the components by means of flow molding.

Alternatively, the ink tank 2 may be molded to have an opening 2*b* at its top, so that the opening 2*b* at the top is covered with an ink tank cap 23 and then hermetically sealed.

An alternative method of using the ink tank cap 23 to cover the top is engaging the ink tank cap 23 with the opening 2*b* in the ink tank 2 to hermetically seal it. The ink tank cap 23 may be screwed down on the ink tank 2.

The invertible ink stamp according to the present invention is assembled in a manner as follows:

First, the ink pad 6 is disposed on the ceiling of the inner casing 1, and thereafter, the fixed axle 52 for the primary ink stamp member 5 is mounted onto the inner casing 1 so as to be slidable through along the slits 12. Next, the ink absorber/retainer member 3 is located on the upper major surface of the ink pad 6. The ink supply tube 21 provided in the ink tank 2 is coupled to the ink absorber/retainer member 3 on its side. With an elastic member 7 being interposed on the inner casing 1 between the inner and outer casing, the outer casing 4 is fitted on the inner casing 1 into a single assembly so that the fixed axle 52 is fitted in the mounting apertures 41 provided in the outer casing 4.

At that time, the distal open end of the ink supply tube 21 is coupled to the ink absorber/retainer member 3. The term 'to couple/to be coupled' herein means that the ink supply tube 21 is connected to the ink absorber/retainer member 3. Methods of coupling and connecting the ink supply tube 21 with the ink absorber/retainer member 3 include joining, press fitting, bonding, and the like.

The term 'to join/to be joined' herein means that two separate pieces of components are connected together; specifically, the ink supply tube 21 is fitted in a mounting aperture provided in advance in the ink absorber/retainer member 3 so that the former is linked up with the latter. Resultantly, the ink absorber/retainer member 3 and the ink supply tube 21 are joined together by frictional force developed between an inner circumferential surface of the mounting aperture and an outer circumferential surface of the ink supply tube 21.

The term 'press fitting' is pressing pieces together in contact; specifically, the ink supply tube 21 is forced to insert itself into the ink absorber/retainer member 3. At this time, the ink absorber/retainer member 3 and the ink supply tube 21 are press fitted by frictional force between the fiber bundle of the ink absorber/retainer member and the outer circumferential surface of the ink supply tube.

The term 'bonding' is using an adhesive medium to join two surfaces by chemical effect or the like; specifically, the ink supply tube having its outer circumferential surface coated with adhesive is fitted in a mounting aperture provided in advance in the ink absorber/retainer member 3 so that an inner circumferential surface of the mounting aperture is bonded with the outer circumferential surface of the ink supply tube by chemical effect. At this time, the distal open end of the ink supply tube 21 must not be filled with the adhesive.

Any of the coupling methods in the present invention includes providing a mounting aperture in advance in a side of the ink-blocking wall member 33 to which the ink supply tube 21 is inserted, and the ink supply tube 21 may be detachably fitted in the mounting aperture.

Various types of ink may be appropriately chosen from water-colored ink, oil ink, dye ink, pigment ink, and the like.

A first embodiment of the present invention typically has a structure as mentioned above, and its functions will be discussed in detail below:

The invertible ink stamp not in use or on standby, which has its lower end in contact with a surface to impress with a desired mark, has the elastic member 7 expanded the most and has the inner and outer casings 1 and 4 spaced the farthest from each other, and the ink stamp face 51 is inverted from its impressing position, coming in contact with the ink pad 6 and being supplied with ink (see FIG. 5A).

Then, a user grips the outer casing 4 suitable in shape for hand holding to move it down. This causes the outer casing 4 moving down to compress the elastic member 7, and simultaneously, the fixed axle 52 fitted in the mounting apertures 41 slides down through along the slits 12. As the outer casing 4 is further moved down, the primary ink stamp member 5 comes in contact with the inversion guides 11. This urges the primary ink stamp member 5 to turn aside around the fixed axle 52. This also forces the inversion shaft 53 to engage with the inversion guides 11, resulting in the primary ink stamp member 5 turning stably without clattering.

As the outer casing 4 is moved further down, the inversion guides 11 make the primary ink stamp member 5 invert by full 180 degrees till the ink stamp face is faced down to get ready for impressing or transferring ink from the ink stamp face onto the surface to impress with a desired mark (see FIG. 5B).

Then, the outer casing 4 is released from being pressed down. This permits the elastic member 7 to repel against compression force, which causes the components of the ink stamp assembly to take a reversed course to the initial standby position so that the ink stamp face 51 comes in contact with the ink pad again and is replenished with ink.

This is a manner of impressing a surface with a desired mark by means of the invertible ink stamp according to the present invention.

An ink supply manner in which the ink absorber/retainer member 3 is supplied with ink through the ink supply tube 21 will now be described.

The ink supply tube 21 or each of the ink supply tubes 21 serves to deliver the ink within the ink tank 2 into the ink absorber/retainer member 3 and also to supply the ink tank 2 with the atmospheric air. As to delivering the ink from the ink tank 2 into the ink absorber/retainer member 3, when the primary ink stamp member has its bottom side down, gravitational force makes the ink in the ink tank 2 pass through the ink supply tube 21 or at least one of the ink supply tubes 21 to the ink absorber/retainer member 3. Simultaneously, the atmospheric air passes through the ink supply tube 21 into the ink tank 2. Thus, the ink absorber/retainer member 3 is impregnated with the ink from the ink tank 2, and the ink impregnating the ink absorber/retainer member 3 is continually delivered to the distal open end of the ink supply tube 21 through which the atmospheric air is taken in.

When the ink impregnating the ink absorber/retainer member 3 reaches the distal open end of the ink supply tube 21 that has served as an external air supply tube, the distal open end of the ink supply tube 21 is blocked by the ink and turned to be airtight, which causes atmospheric air supply into the ink tank 2 to be interrupted. This, in turn, causes the ink supply tube 21 having supplied ink so far to interrupt ink supply from the ink tank 2 to the ink absorber/retainer member 3.

In this way, ink flow from the ink tank 2 and air flow into the same (that is, replacement of the ink with the atmospheric air) is interrupted, the ink tank 2 gets temporarily hermetically sealed.

Impressing mark successively with the ink stamp in this manner, the ink pad in which ink has been consumed is replenished with ink supplied through the ink outlet 3*a* provided in the ink absorber/retainer member 3. The ink that has been supplied from the ink absorber/retainer member 3 to the ink pad 6 is replaced with the ink from the ink tank 2 through the ink supply tube 21, and the user can continue to impress mark till he or she completely uses up the ink in the ink tank 2.

The single ink supply tube 21 may be enough to serve to supply ink from the ink tank 2 into the ink absorber/retainer member 3 and to serve to supply the ink tank 2 with the atmospheric air.

When the atmospheric temperature changes while the ink tank 2 is hermetically sealed, the pressure inside the ink tank 2 accordingly changes. When the atmospheric temperature rises from a temperature level while the ink tank 2 is hermetically sealed, the air within the ink tank 2 expands to cause the internal pressure to rise, which results in ink being ejected out of the ink supply tube 21. Since the ink ejected out is absorbed into the absorbent member 31 that has the air outlet 31*a* and is conductive to the atmospheric air, or otherwise, is absorbed into or blocked by a wall material, the ink would not move to the ink stamp face. The wall member absorbing ink in this manner may be the fiber wall member 32 or the porous material, and the wall material blocking ink in such a manner may be the aforementioned ink-blocking wall material.

When the atmospheric temperature goes down while the ink tank 2 is hermetically sealed, the pressure inside the ink tank 2 accordingly reduces, and the ink that has been ejected out is sucked back into the ink supply tube 21.

Reverse to the previously mentioned situation, when the atmospheric temperature goes down from a temperature level while the ink tank 2 is hermetically sealed, the air inside the ink tank 2 is compressed to reduce the internal pressure, and this causes the ink supply tube 21 to suck back the ink in the vicinity of its open end. Under the circumstances, when the atmospheric temperature goes up, the pressure inside the ink tank 2 accordingly rises, the ink that has been sucked up is ejected from the ink supply tube 21.

When the ink tank 2 is replenished with ink, first the outer casing 4 is removed to take out the ink tank 2, which then is to be replaced with new one.

Figure 6:
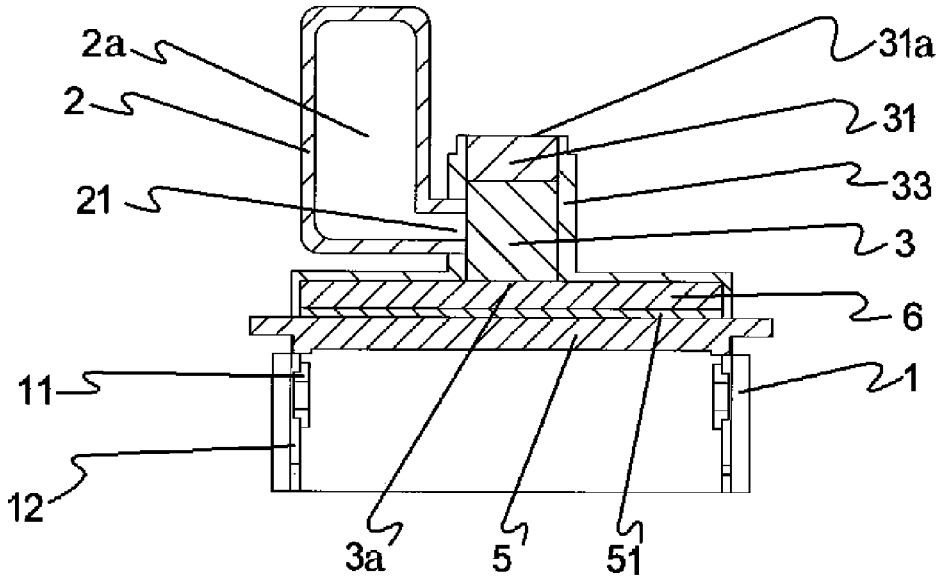
FIG. 6 is a diagram showing second and fourth embodiments of the present invention.

A second embodiment of the present invention will now be described in detail with reference to FIG. 6. Hereinafter, differences from the previously described embodiment alone will be discussed.

In this embodiment, the wall member surrounding the ink absorber/retainer member 3 and the absorbent member 31 is the ink-blocking wall member 33. A lower surface of the ink-blocking wall 33 is in contact with the upper major surface of the porous ink pad 6. The ink-blocking wall member 33 may be made of any of substances, such as resins like plastic, resin film, metals, and the like, that can block ink. When made of resin or metal, it may be shaped in double ended cylinder. When made of resin film, it is adapted to wind the resin film around the ink absorber/retainer member 3 and the absorbent member 31.

A cross section taken along outer and inner circumferences of the ink supply tube 21 may be in any shape of a circle, an ellipse, and polygons such as a triangle, a rectangle, and the like. A distal open end of the ink supply tube 21 may be directed horizontally, namely, laterally outward. The distal open end of the ink supply tube 21 may take any of various shapes, including a bevel, a steep or orthogonal surface, a conically curved surface, a convexly curved surface, and so forth.

The second embodiment of the present invention typically has a structure as mentioned above, and its functions will be discussed in detail below:

In this embodiment, when the atmospheric temperature changes while the ink tank 2 is hermetically sealed, the pressure inside the ink tank 2 accordingly changes. When the atmospheric temperature rises from a temperature level while the ink tank 2 is hermetically sealed, the air within the ink tank 2 expands to cause the internal pressure to rise, which results in ink being ejected out of the ink supply tube 21. Since the ink ejected out is blocked by the wall member 33 and instead absorbed into the absorbent member 31 that has the air outlet 31*a* and is conductive to the atmospheric air, the ink would not move to the ink pad 6, and no overflow of ink from the ink pad 6 is caused. Under the circumstances, when the atmospheric temperature goes down, the pressure inside the ink tank 2 reduces, and resultantly, the ink that has been ejected out is sucked back into the ink supply tube 21.

Reverse to the above mentioned situation, when the atmospheric temperature goes down from a temperature level while the ink tank 2 is hermetically sealed, the air inside the ink tank 2 is compressed to reduce the internal pressure, and this causes the ink supply tube 21 to suck back the ink in the vicinity of its open end. Under the circumstances, when the atmospheric temperature goes up, the pressure inside the ink tank 2 accordingly rises, and the ink that has been sucked up is ejected from the ink supply tube 21.

Figure 7:
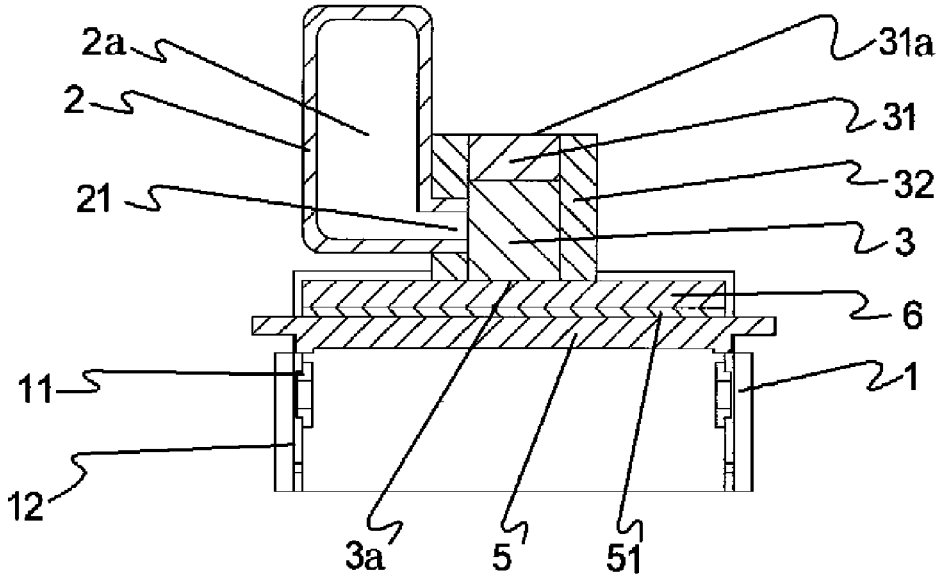
FIG. 7 is a diagram showing a third embodiment of the present invention.

A third embodiment of the present invention will now be described with reference to FIG. 7. Hereinafter, differences from the previously described embodiments along will be discussed.

In this embodiment, the wall member is the fiber wall member 32 that is weaker in capillary attraction than the ink absorber/retainer member 3. The fiber wall member 32 is air-permeable and has its bottom surface in contact with the upper major surface of the porous ink pad 6. Since the fiber wall member 32 has a weaker capillary attraction compared with the ink absorber/retainer member 3, ink is hard to move from the ink absorber/retainer member 3 to the fiber wall member 32.

The fiber wall member 32 may be made of any of materials that have micropores; for example, resin impregnated/coated fiber bundle, thermally fused fiber bundle, felted material, needle punched felt, porous materials such as porous foamed synthetic resin, extruded synthetic resin molding with axial ink guide channels, or the like. Such materials may be made of any of synthetic resin fibers such as acrylic fiber, polyester fiber, and the like. The fiber wall member 32 may be made of the same substance but does not have to be.

Alternatively, the fiber wall member 32 may have a cover of any suitable material such as synthetic resin film wrapped around its outer circumferential surface.

The fiber wall member 32 may be replaced with a wall member made of any of porous materials. The porous materials referred to herein include thermoplastic resins, thermoset resins, rubber, glass, ceramics, metals, and the like each of which is foamed by any well-known means to have contiguous foams but has a reduced capillary attraction compared with the ink absorber/retainer member 3.

The third embodiment of the present invention has a structure as mentioned above, and its functions will be discussed in detail below:

In this embodiment, the ink-blocking wall member 33 in the second embodiment is replaced with the fiber wall member 32.

When the atmospheric temperature changes while the ink tank 2 is hermetically sealed, the pressure inside the ink tank 2 accordingly changes. When the atmospheric temperature rises from a temperature level while the ink tank 2 is hermetically sealed, the air within the ink tank 2 expands to cause the internal pressure to rise, which results in ink being ejected out of the ink supply tube 21. Since the ink ejected out is absorbed into the absorbent member 31 that has the air outlet 31*a* and is conductive to the atmospheric air, or otherwise, absorbed into the fiber wall member 32 and would not move to the ink pad 6, no overflow of ink from the ink pad 6 is caused. Under the circumstances, when the atmospheric temperature goes down, the pressure inside the ink tank 2 reduces, and resultantly, the ink that has been ejected out is sucked back into the ink supply tube 21. The remaining functions of this embodiment are similar to those of the second embodiment.

A fourth embodiment of the present invention will now be described in detail with reference to FIGS. 6 and 8. Hereinafter, differences from the previous embodiments alone will be discussed.

In this embodiment, the ink supply tube 21 is disposed on one lateral side of the ink absorber/retainer member 3, and the ink supply tube 21 has its distal open end coupled to a surface of the ink absorber/retainer member 3. In one method to that end, the ink supply tube 21 is fitted in a through-hole that is provided in advance in the fiber wall member 32 or the ink-blocking wall member 33. The ink supply tube 21 is to be designed suitably to have its distal open end mounted on and coupled to the surface of the ink absorber/retainer member 3 on either of the lateral sides.

The fourth embodiment of the present invention has a structure as mentioned above that is similar to the first to third embodiments except that the distal open end of the ink supply tube 21 is coupled to the surface of the ink absorber/retainer member 3 on either of the lateral sides.

Figure 8:
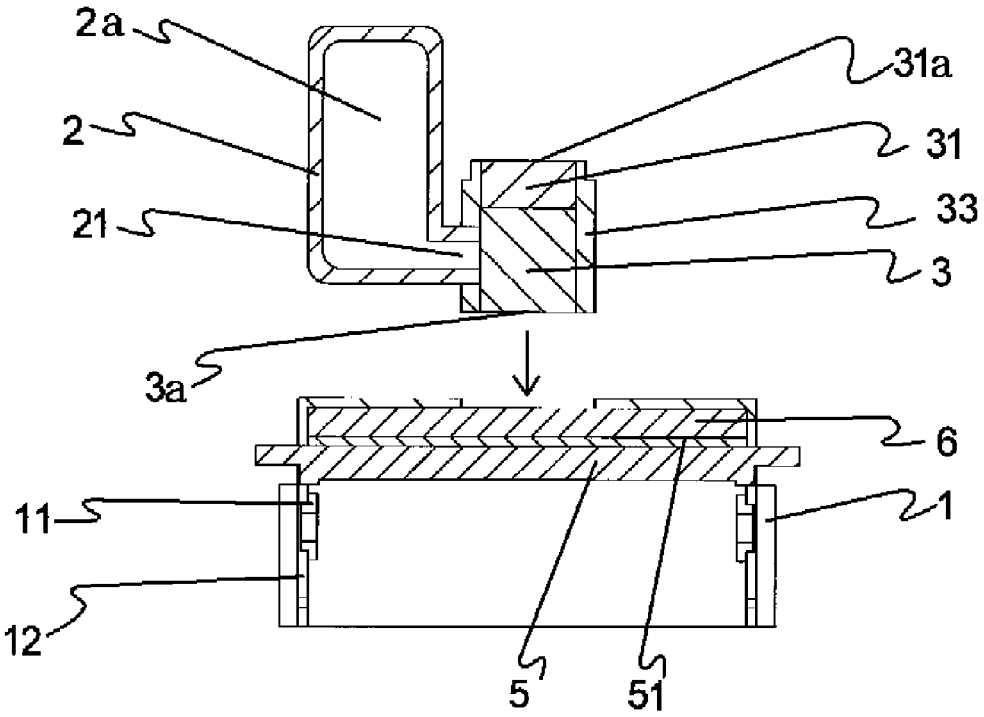
FIG. 8 is a diagram showing an ink tank of the fourth embodiment being attached.

Also, as shown in FIG. 8, as to the replenishment with ink by replacing the ink tank 2 with a new one, the ink absorber/retainer member 3, the absorbent member 31, and the ink-blocking wall member 33 or the fiber wall member 32 may be replaced with new ones, respectively. In such a case, the ink-blocking wall member 33 and the ink supply tube 21 may be attachable/detachable to and from each other. Alternatively, the ink-blocking wall member 33 and the ink supply tube 21 may be joined in a unit.

Figure 9:
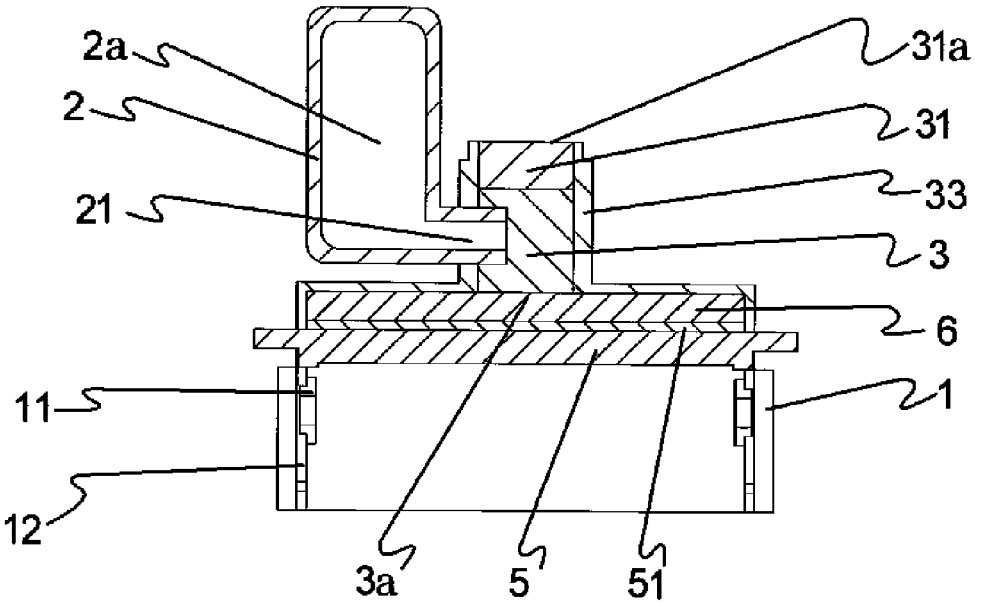
FIG. 9 is a diagram of a fifth embodiment of the present invention.
Figure 10:
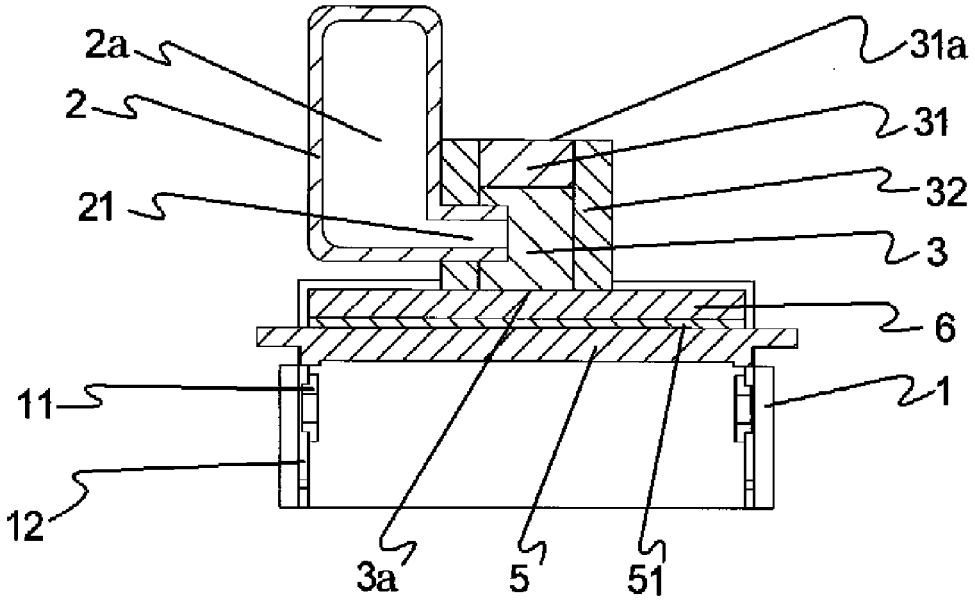
FIG. 10 is a diagram showing an alternative wall member in the fifth embodiment.

A fifth embodiment of the present invention will be described in detail with reference to FIGS. 9 and 10. Hereinafter, differences from the previous embodiments alone will be discussed.

In this embodiment, the ink supply tube 21 is disposed on either of lateral sides of the ink absorber/retainer member 3, and the ink supply tube 21 has its distal open end coupled to an inner portion of the ink absorber/retainer member 3. In one method to that end, the ink supply tube 21 is inserted in a through-hole that is provided in advance in the fiber wall member 3 or the ink-blocking wall member 33. Also, the ink supply tube 21 has its distal open end fitted in a mounting aperture that is provided in advance in a surface of the ink absorber/retainer member 3 on the lateral side, and thus, the ink supply tube 21 is to be designed to reach the inner portion of the ink absorber/retainer member 3 and be coupled thereto.

In this embodiment, methods of coupling and connecting the ink supply tube 21 with the ink absorber/retainer member 3 include joining, press fitting, bonding, and the like.

Joining is connecting two separate pieces of components together; specifically, the ink supply tube 21 is fitted in the mounting aperture provided in advance in the ink absorber/retainer member 3. Resultantly, the ink absorber/retainer member 3 and the ink supply tube 21 are joined together by frictional force developed between an inner circumferential surface of the mounting aperture and an outer circumferential surface of the ink supply tube 21.

Press fitting is pressing pieces together in contact; specifically, the ink supply tube 21 is forced to insert itself into the ink absorber/retainer member 3. Resultantly, the ink absorber/retainer member 3 and the ink supply tube 21 are press fitted by frictional force between the fiber bundle of the ink absorber/retainer member 3 and the outer circumferential surface of the ink supply tube 21.

Bonding is using an adhesive medium to join two surfaces by chemical effect or the like; specifically, the ink supply tube 21 having its outer circumferential surface coated with adhesive is fitted in the mounting aperture provided in advance in the ink absorber/retainer member 3 so that an inner circumferential surface of the mounting aperture is bonded with the outer circumferential surface of the ink supply tube 21 by chemical effect. At this time, the distal open end of the ink supply tube 21 must not be filled with the adhesive.

Any of the coupling methods in this embodiment includes providing a through-hole in advance in a side of the ink-blocking wall member 33, inserting the ink supply tube 21 in the through-hole, and then, fitting it in a mounting aperture that has also been provided in advance in a side surface of the ink absorber/retainer member 3 to connecting both the components together as mentioned above. As a consequence, the ink retainer 3 and the ink supply tube 21 are in connection by means of frictional force developed between the inner circumferential surface of the mounting aperture and the outer circumferential surface of the ink supply tube 21.

The fifth embodiment of the present invention has a structure as mentioned above and is similar to the fourth embodiment except that the ink supply tube 21 has its distal open end coupled with the ink absorber/retainer member 3 somewhat deeper inside. In this embodiment, since the distal open end of the ink supply tube 21 is connected with the inner portion of the ink absorber/retainer member 3, a more secure connection of the ink supply tube 21 with the ink absorber/retainer member 3 can be obtained.

Figure 11:
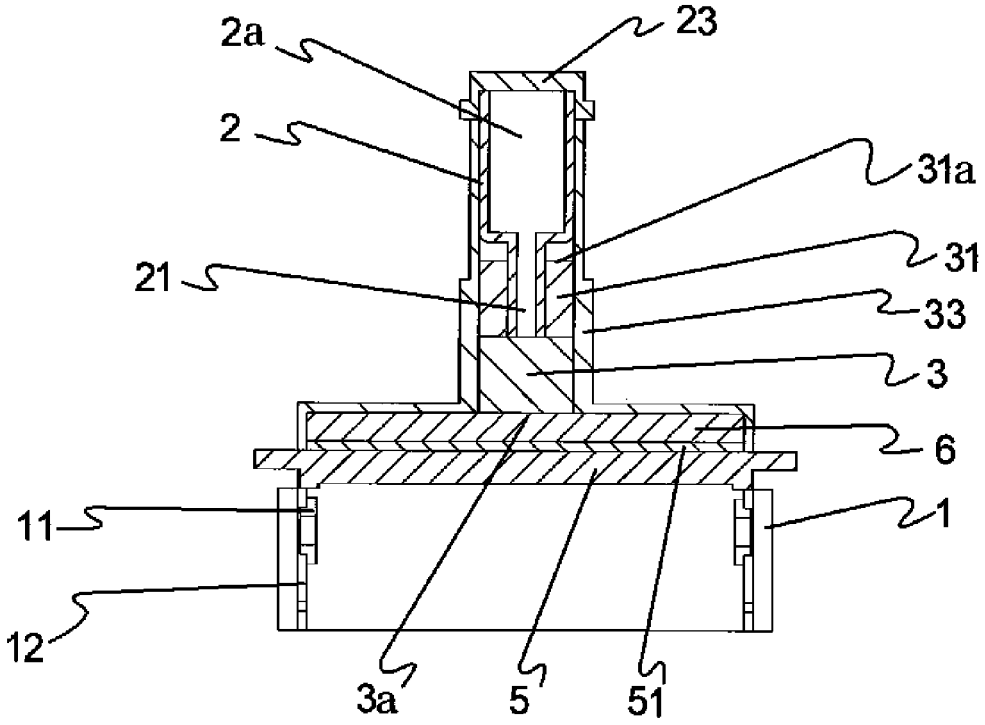
FIG. 11 is a diagram showing a sixth embodiment.

A sixth embodiment of the present invention will now be described in detail with reference to FIG. 11. Hereinafter, difference from the previous embodiments alone will be discussed.

In this embodiment, the ink supply tube 21 is disposed on top of the ink absorber/retainer member 3, and the ink supply tube 21 has its distal open end coupled to an upper major surface of the ink absorber/retainer member 3. In one method to that end, a through-hole is provided in advance in an upper major surface of the absorbent member 31, and the ink supply tube 21 is fitted in the through-hole. The ink supply tube 21 is to be designed to have its distal open end mounted on and connected with the upper major surface of the ink absorber/retainer member 3.

Figure 12:
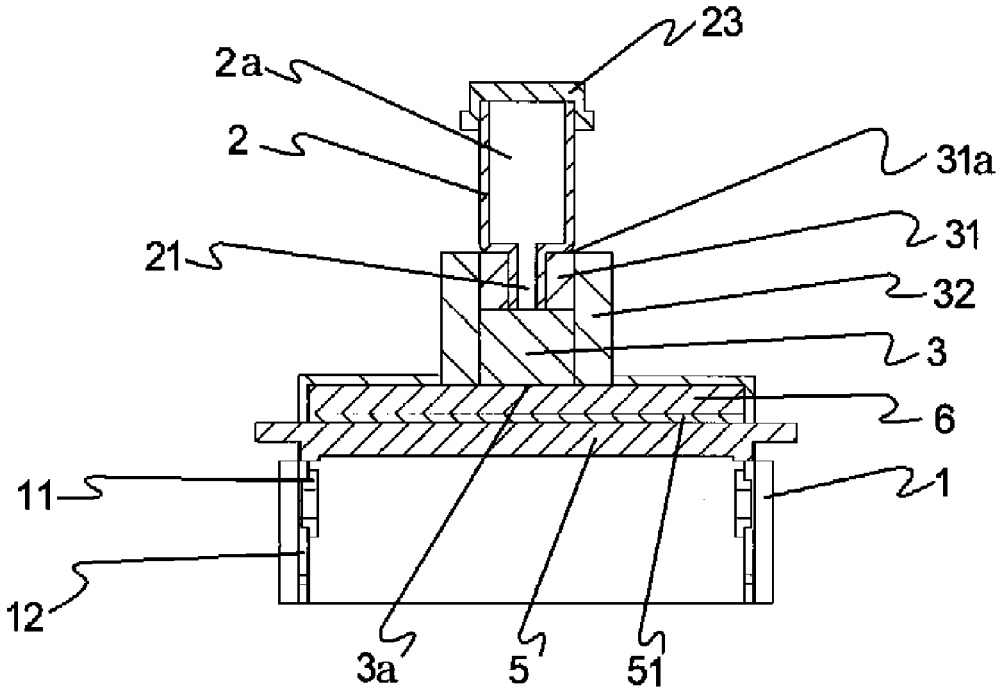
FIG. 12 is a diagram showing an alternative wall member in the sixth embodiment.

The sixth embodiment has a structure as mentioned above and is similar to the first to third embodiments except that the distal open end of the ink supply tube 21 is coupled with the upper major surface of the ink absorber/retainer member 3. Alternatively, as can be seen in FIG. 12, a modified version of the sixth embodiment combined with the third embodiment may be contemplated.

Figure 13:
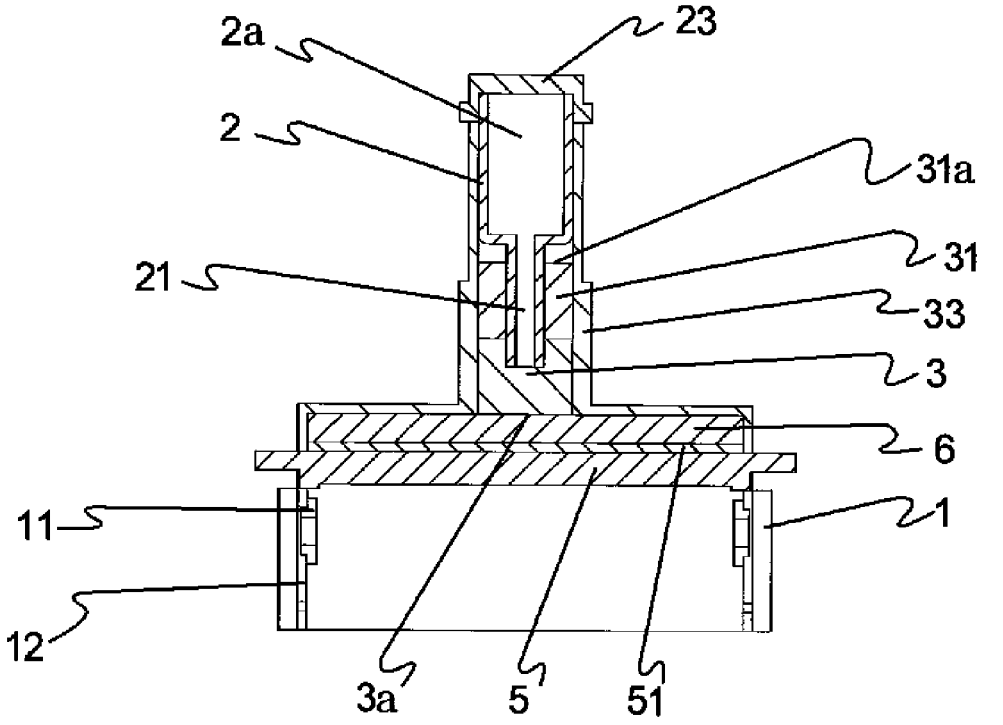
FIG. 13 is a diagram showing a seventh embodiment of the present invention.

A seventh embodiment of the present invention will now be described with reference to FIG. 13. Hereinafter, differences from the previous embodiments alone will be discussed.

In this embodiment, the ink supply tube 21 is disposed on top of the ink absorber/retainer member 3, and the ink supply tube 21 has its distal open end coupled to an inner portion of the ink absorber/retainer member 3. In one method to that end, a through-hole is provided in advance in an upper major surface of the absorbent member 31, and the ink supply tube 21 is inserted in the through-hole. Also, the ink supply tube 21 has its distal open end fitted in a mounting aperture that is provided in advance in an upper major surface of the ink absorber/retainer member 3, and thus, the ink supply tube 21 is to be designed to reach the inner portion of the ink absorber/retainer member 3 and be coupled thereto.

In this embodiment, methods of coupling and connecting the ink supply tube 21 with the ink absorber/retainer member 3 are the same as those described in the context of the fifth embodiment.

Figure 14:
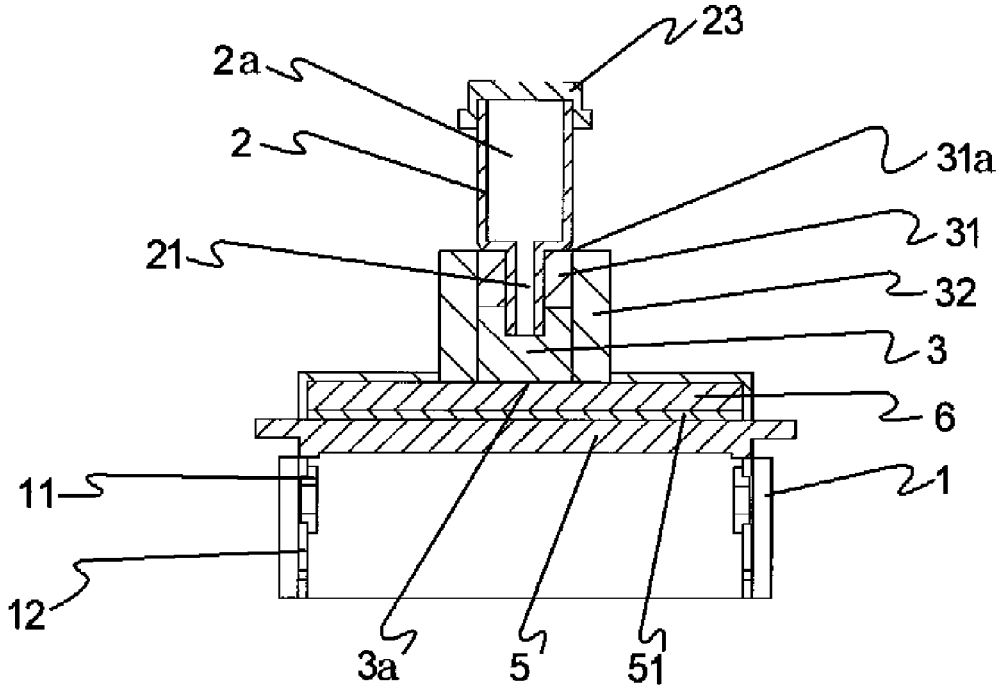
FIG. 14 is a diagram showing an alternative wall member in the seventh embodiment.
Figure 15:
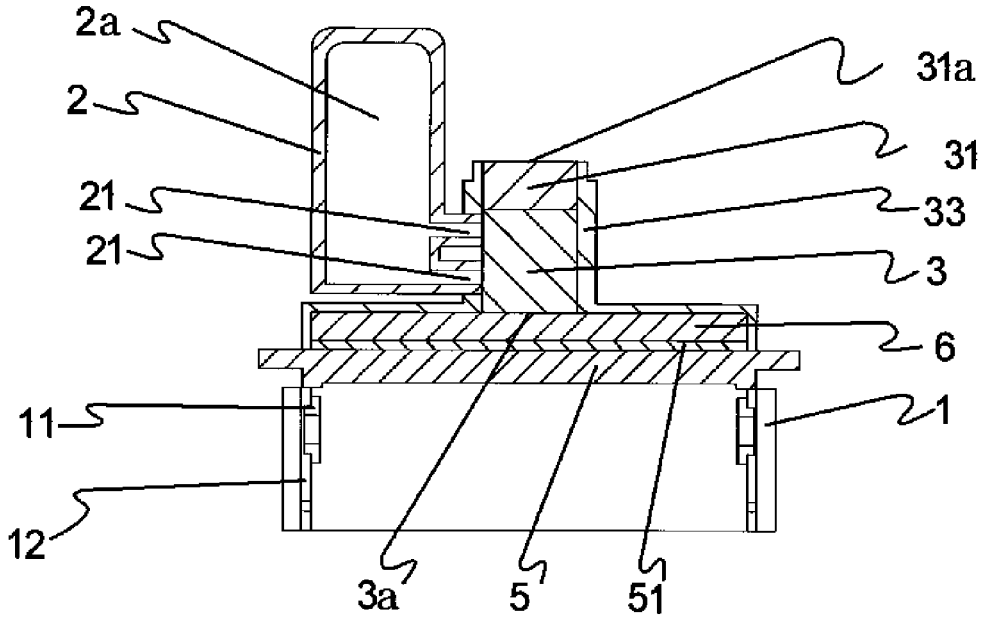
FIG. 15 is a diagram showing an eighth embodiment of the present invention.

The seventh embodiment has a structure as mentioned above and is similar to the sixth embodiment except that the distal open end of the ink supply tube 21 is coupled with the inner portion of the ink absorber/retainer member 3. In this embodiment, since the distal open end of the ink supply tube 21 is connected with the inner portion of the ink absorber/retainer member 3, a more secure connection of the ink supply tube 21 with the ink absorber/retainer member 3 can be obtained. In addition, as will be recognized in FIG. 14, a modified version of the seventh embodiment combined with the third embodiment can be contemplated.

An eighth embodiment of the present invention will now be described in detail with reference to FIGS. 15 to 24. Hereinafter, difference from the previous embodiments alone will be discussed.

In this embodiment, more than one of the ink supply tubes 21 may be disposed, and a representative case in which there are two of the ink supply tubes 21 will be discussed below. A cross section taken along outer and inner circumferences of each of the ink supply tubes 21 may be in any shape of a circle, an ellipse, and polygons such as a triangle, a rectangle, and the like. A distal open end of each of the ink supply tubes 21 may be directed downward, or otherwise, laterally outward. The distal open end of each of the ink supply tubes 21 may take any of various shapes, including a bevel, a steep or orthogonal surface, a conically curved surface, a convexly curved surface, and so forth.

As shown in FIG. 16, the ink supply tubes 21 may have their respective circumferential walls coupled to each other. Such a manner is just the same as a single tube separated by an axially extended partition wall 21*a* into side-by-side ducts which serve as two independent ink supply tubes 21 in parallel with each other inside the single tube.

As can be seen in FIG. 17, two of the ink supply tubes 21 may be disposed so that one smaller in diameter may be located within the other larger in diameter. In such a manner, an inner circumferential surface of the larger ink supply tube 21 together with an outer circumferential surface of the smaller ink supply tube 21 define a channel having an annular cross section, and the smaller ink supply tube 21 provides an inner channel having a circular cross section.

The eight embodiment of the present invention has a structure as mentioned above, and its functions will be described in detail below:

The eight embodiment is similar to the previous embodiments except that each of two of the ink supply tube 21 of the present invention serves to deliver the ink within the ink tank 2 into the ink absorber/retainer member 3 and also to supply the ink tank 2 with the atmospheric air.

Some modified versions of the eighth embodiment combined with the second embodiment are depicted in FIGS. 15, 18, 19, and 20. In this embodiment, the ink-blocking wall member 33 is chosen to surround both the ink absorber/retainer member 3 and the absorbent member 31.

Some other modified versions of the eighth embodiment in combination with the third embodiment are depicted in FIGS. 21 to 24. In these embodiments, the fiber wall member 32 is chosen to surround both the ink absorber/retainer member 3 and the absorbent member 31.

A ninth embodiment of the present invention will now be described in detail with reference to FIG. 25. Hereinafter, differences from the previous embodiments alone will be discussed.

Figure 25:
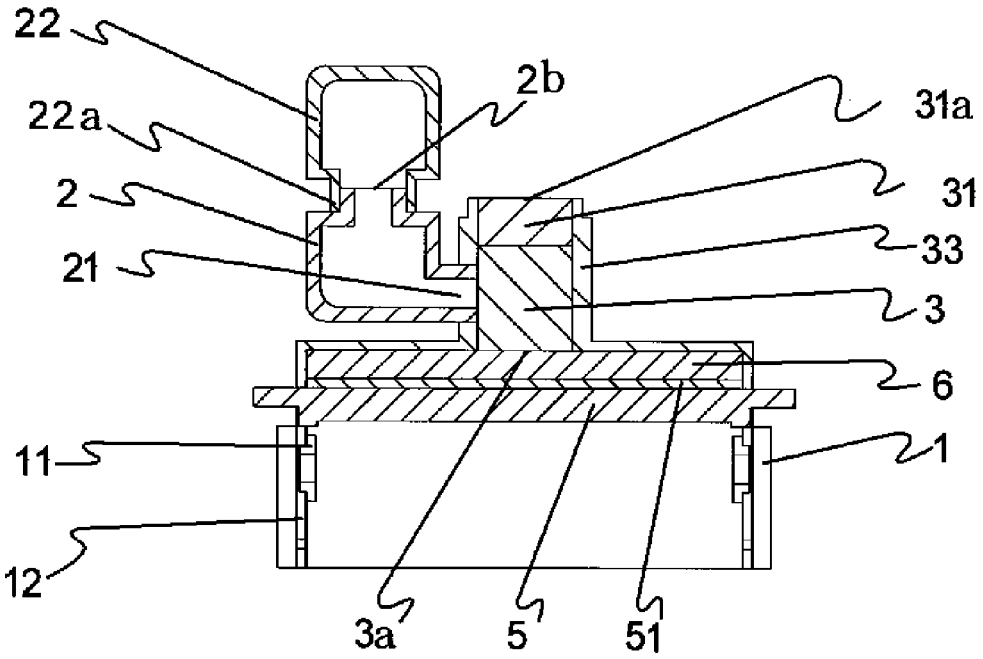
FIG. 25 is a diagram showing a ninth embodiment of the present invention.

As shown in FIG. 25, an attachable/detachable refill ink cartridge 22 may be fitted in an orifice 2*b*. The refill ink cartridge 22 is shaped like an open top cylinder having its one end 22*a* left open, and the open end 22*a* is engaged with the orifice 2*b*. Such engagement of the open end 22*a* with the orifice 2*b* enables the refill ink cartridge 22 to be hermetically sealed. The refill ink cartridge 22, being hermetically sealed in this manner, can prevent ink inside from leaking. The point of the engagement between the open end 22*a* and the orifice 2*b* may be the same as the point along which the refill ink cartridge is sealed, or does not have to be. The engagement is attainable in various ways, including meshing of mating components, pressure fitting, thread fastening, and the like.

The refill ink cartridge 22 in user's custody has the open end 22*a* tightly covered with a cap (not shown), and in use, the cap is removed to fit the refill ink cartridge 22 in the orifice 2*b*. While being attached to the ink tank 2 over the orifice 22*a*, the open end 22*a* of the refill ink cartridge 22 should be upside so as not to spill the ink inside.

The ninth embodiment of the present invention has a structure as mentioned above, and its functions will be described in detail below:

When the current refill ink cartridge 22 has to be replaced with new one because it is out of ink, first the current refill ink cartridge 22 is removed from the ink tank 2. During removing the cartridge, the ink tank 2 is still coupled with the ink-blocking wall member 33. Then, the new refill ink cartridge 22 is attached to the ink tank 2 by covering the orifice 2*b* with the open end 22*a* of the cartridge.

A tenth embodiment of the present invention will now be described in detail with reference to FIGS. 26 to 28. Hereinafter, differences from the previous embodiments alone will be discussed.

Figure 26:
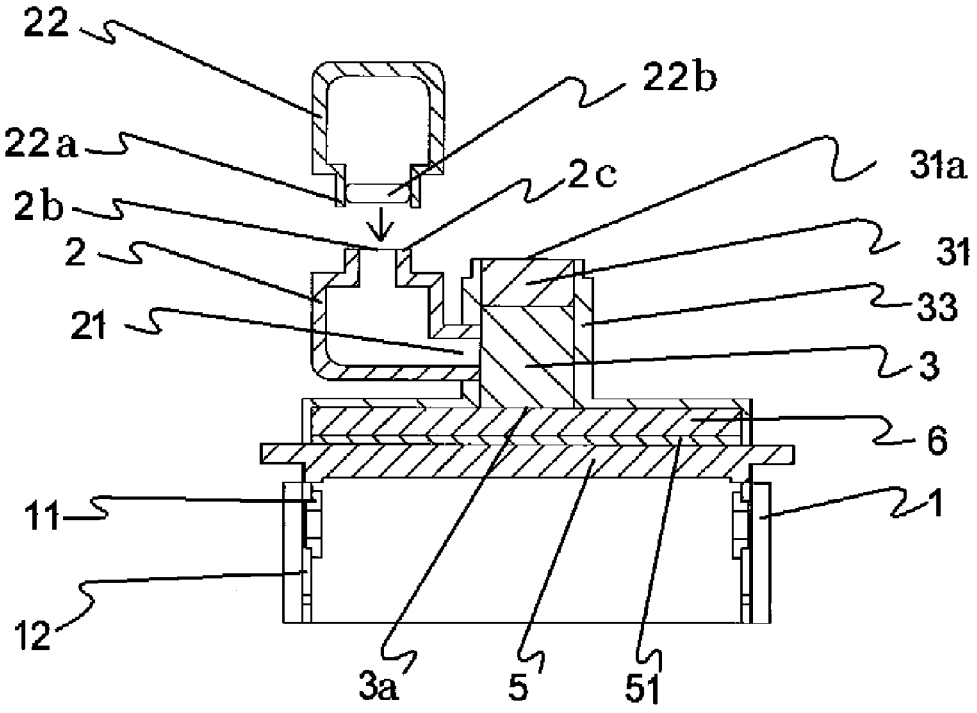
FIG. 26 is a diagram showing a refill ink cartridge being attached in a tenth embodiment of the present invention.
Figure 27:
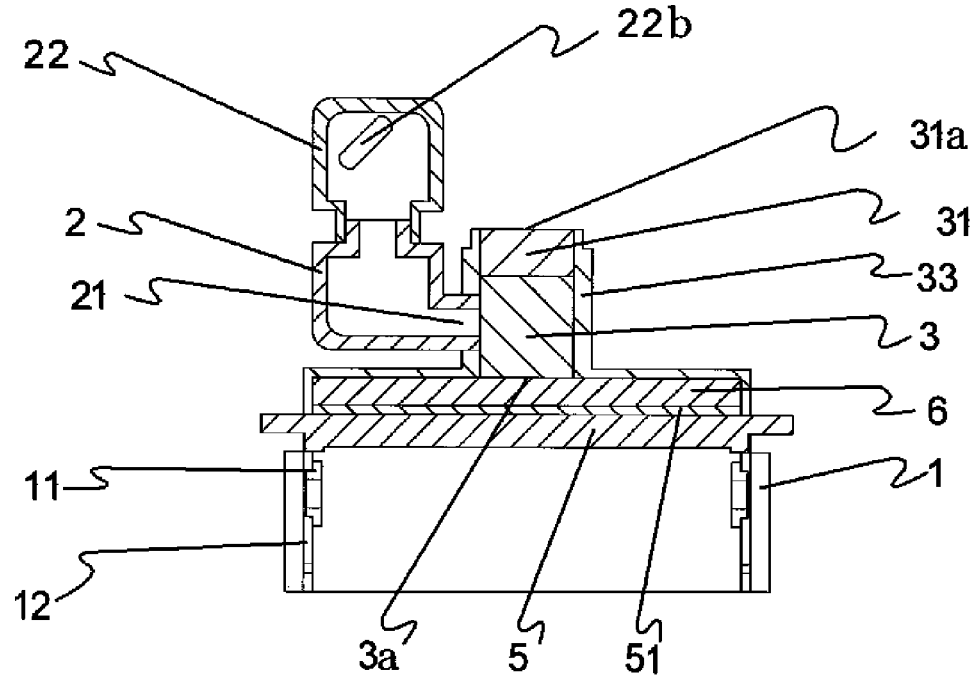
FIG. 27 is a diagram showing the tenth embodiment.
Figure 28A:
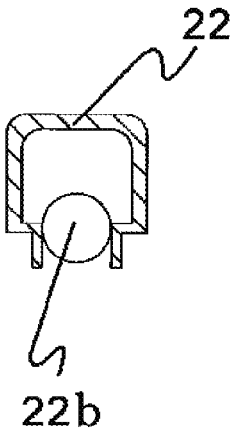
FIGS. 28A and 28B are sectional diagrams showing alternative refill ink cartridges in the tenth embodiment and a nineteenth embodiment of the present invention.
Figure 28B:
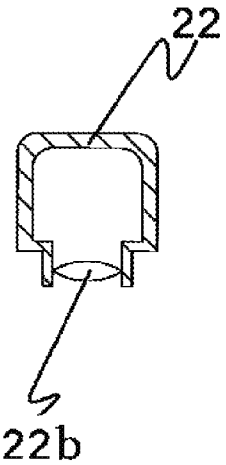

As can be seen in FIGS. 26 to 28, a plate-shaped plug 22*b* may be put in the open end 22*a*. The plug 22*b* sealing the new refill ink cartridge 22 in user's custody is not removed from the open end 22*a* till the new cartridge 22 is attached to the ink tank 2. During attaching it to the ink tank 2, the user puts the plug 22*b* over an opener plunger 2*c* on a rim of the ink tank 2 and forces the plug 22*b* to be pressed up to pop it into the refill ink cartridge 22 itself. Similar to the previous embodiments, the ink tank 2 is also hermetically sealed by the open end 22*a* of the refill ink cartridge 22 engaged with the orifice 2*b*.

In order to avoid an inadvertent leakage of ink, the refill ink cartridge 22 once secured to the ink tank by the hermetical seal of its open end 22*a* over the orifice 2*b* is desirably moved as little as possible to completely pop the plug 22*b* off. The opener plunger 2*c* for pressing the plug may be a bare rim of the ink tank 2, or alternatively, may be a projection(s) specifically provided thereon.

There are a variety of types of the plug 22*b* so as to select one as desired among a ball-shaped plug (FIG. 28A), a lens-shaped plug (FIG. 28B), and so on. The plug 22*b* may be a film or any appropriate kind (not shown) that is rupturable by using the opener plunger 2*c*.

The tenth embodiment of the present invention has a structure as mentioned above, and its functions will be described in detail below:

In this embodiment where the plug 22*b* is put in the open end 22*a*, the opener plunger 2*c* presses the plug 22*b* into the refill ink cartridge to open the refill ink cartridge 22. In this manner, similar to the previous embodiments, the ink tank 2 is hermetically sealed by the open end 22*a* of the refill ink cartridge 22 over the orifice 2*b*.

In order to avoid an inadvertent leakage of ink, the refill ink cartridge 22 once secured to the ink tank 2 by the hermetical seal of its open end 22*a* over the orifice 2*b* is desirably moved as little as possible to completely pop the plug 22*b* off. The opener plunger 2*c* for pressing the plug may be a bare rim of the ink tank 2, or alternatively, may be a projection(s) specifically provided thereon.

An eleventh embodiment of the present invention will be described in detail with reference to FIGS. 29 and 30. Hereinafter, differences from the previous embodiments alone will be discussed.

Figure 29:
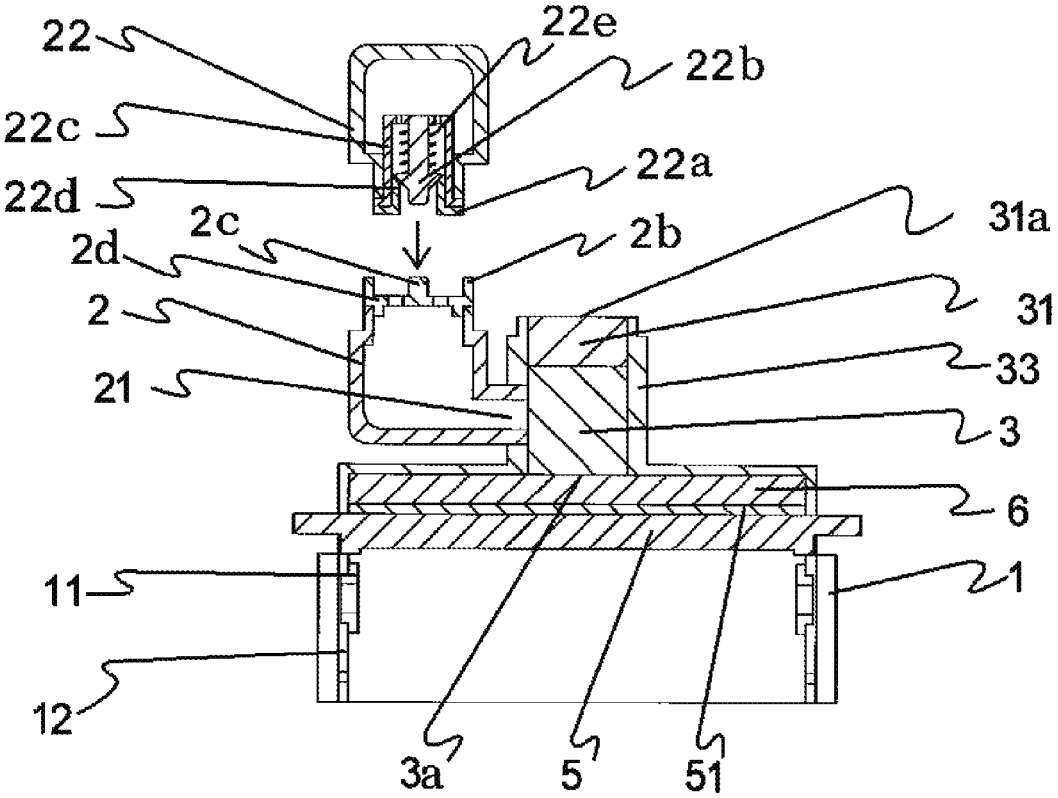
FIG. 29 is a diagram showing a refill ink cartridge being attached in an eleventh embodiment of the present invention.
Figure 30:
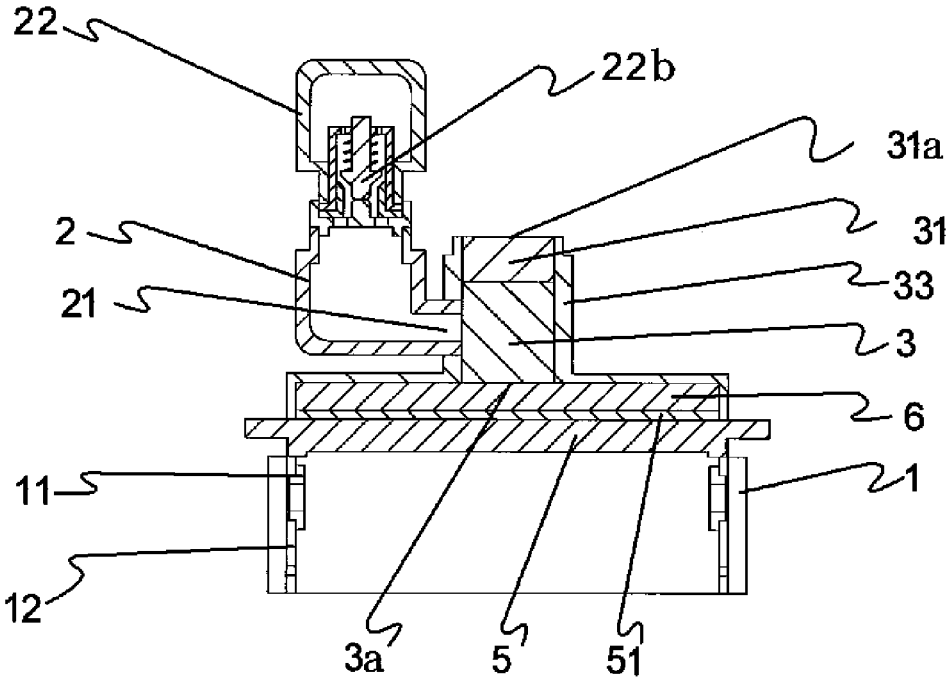
FIG. 30 is a diagram showing the eleventh embodiment.
Figure 31:
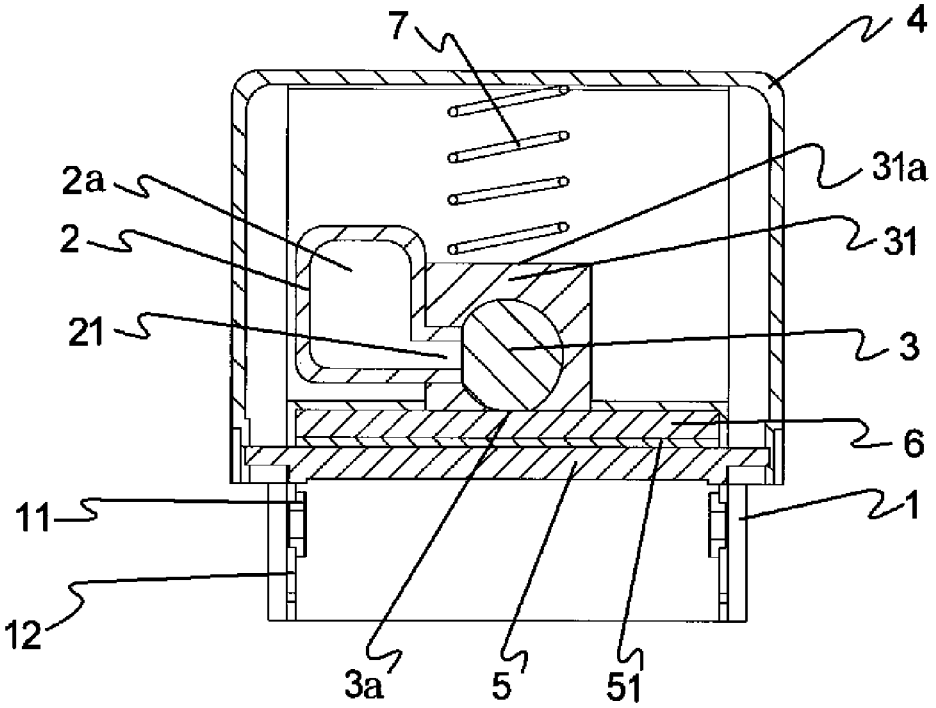
FIG. 31 is a sectional view of the twelfth embodiment, taken along the line A-A in FIG. 1.

As shown in FIGS. 29 and 30, a valve device may be located in the open end 22*a* of the refill ink cartridge 22 as an alternative form to the plug 22*b*, and such a valve device is adapted to open when pushed up by the opener plunger 2*c* and to close when released from the opener plunger 2*c*.

The valve device comprises a cylindrical valve body 22*c*, a valve cap 22*d*, the plug 22*b*, and a coil spring 22*e*. The valve cap 22*d*, which has the plug 22*b* incorporated along with the coil spring 22*e*, is fitted in an opening of the cylindrical valve body 22*c*. Surrounding an ink flow path through the valve cap 22*d*, a valve seat is disposed and engaged with a valve member provided in the plug 22*b*, and usually, elastic force of the coil spring 22*e* pressing the valve member permits it to make an airtight seal with the valve seat.

When pressed up by the opener plunger 2*c*, the plug 22*b* is moved upward against the elastic force of the coil spring 22*e* to release the air tight pressure the valve member applied to the valve seat, which permits the ink inside the refill ink cartridge to flow into the ink tank 2. When released from the upward pressing force by the opener plunger 2*c*, the plug 22*b* effected by the elastic force of the coil spring 22*e* makes the valve member to press on the valve seat for an airtight seal again to put the plug back in the closed position.

The opener plunger 2*c* may be integrally formed with the ink tank 2, or otherwise, may be separately formed as shown in the drawings. When they are formed in separate units, an inner plug 2*d* put in the orifice 2*b* and attached to the ink tank 2 is provided with the opener plunger 2*c* on top, and a rim of the orifice 2*b* surrounds the opener plunger 2*c*. The open end 22*a* of the refill ink cartridge 22 is detachably fitted in the orifice 2*b*. Similar to the previous embodiments, the ink tank 2 is hermetically sealed at its orifice 2*b* by the open end 22*a* of the refill ink cartridge 22.

An eleventh embodiment of the present invention has a structure as mentioned above, and its functions will be described in detail below:

For the aforementioned valve device of which plug 22*b* is pressed up by the opener plunger 2*c* and has its valve member opened so as to open the ink flow path, there is no restriction on the direction in which the open end 22*a* faces. In other words, the open end 22*a* may take any orientation in attaching it to the ink tank over the orifice on the bottom up, top down, or sideways basis, as desired.

When the current refill ink cartridge 22 is removed from the ink tank 2 in order to replace with a new refill ink cartridge 22, the remnant ink within the current refill ink cartridge 22 is prone to leak out. With the valve device being used, however, the valve member works to close the open end 22*a* during the removal of the current refill ink cartridge from the ink tank, and no ink leakage is caused.

Although the ninth to eleventh embodiments have been described in conjunction with the fourth embodiment, they may be modifications of the fifth to eighth embodiments to attain the similar effects. FIGS. 6 to 29 are provided by way of example in which the outer casing 4 is omitted.

A twelfth embodiment of the present invention will be described in detail with reference to FIGS. 1 to 3, FIG. 31 and FIG. 32. Hereinafter, differences from the previous embodiments alone will be discussed.

The absorbent member 31 is disposed on top of the ink pad 6.

The absorbent member 31 serves also as the ink absorber/retainer member 3. In other words, the ink absorber/retainer member 3 and the absorbent member 31 are made of the same material and formed as one.

In one method of assembling them, the distal open end of the ink supply tube 21 is press fitted in the absorbent member 31 from its top or either of the lateral sides to convert the absorbent member 31 to use as the ink absorber/retainer member 3 in the vicinity of the distal open end of the ink supply tube 21. In this way, the absorbent member 31 has its inner part converted to intrinsic use as the ink absorber/retainer member 3, and the remaining part of its upper and laterally opposite sides serves as the retainer member 31 that is weaker in capillary attraction than the ink absorber/retainer member but is sufficiently useful to absorb the excessive ink.

The absorbent member 31 may be made of any material that has micropores; for instance, resin impregnated/coated fiber bundle, thermally fused fiber bundle, felted material, needle punched felt, porous materials such as porous foamed synthetic resin, extruded synthetic resin molding with axial ink guide channels, or the like. Such materials may be made of any of synthetic resin fibers such as acrylic fiber, polyester fiber, and the like.

The capillary attraction is a capability of capillary rise, and in this invention, it refers to a capability of inducing ink to flow through the micropores. Since the absorbent member 31 has a weaker capillary attraction compared with the ink absorber/retainer member 3, ink in the latter is hard to flow to the former.

Part or all of an outer surface of the absorbent member 31 is left open to serve as an air vent 31*a* conductive to the external atmosphere so as to allow air to pass out of or into the absorbent member 31.

Part or all of a lower major surface of the ink absorber/retainer member 3 is left open to serve as the ink outlet 3*a*. The ink retainer 3 is on top of the ink pad 6. The ink pad 6 and the ink outlet 3*a* are contiguous to each other. A capillary attraction effect working between the ink pad 6 and the ink absorber/retainer member 3 can be adjusted so as to apply an appropriate amount of ink to the ink pad 6.

The absorbent member 31 may have its outer circumferential surface coated with synthetic resin film or the like.

The invertible ink stamp according to the present invention is assembled in a manner as follows:

First, the ink pad 6 is disposed on the ceiling of the inner casing 1, and thereafter, the fixed axle 52 for the primary ink stamp member 5 is mounted onto the inner casing 1 so as to be slidable through along the slits 12. Next, the ink absorber/retainer member 3 is located on the upper major surface of the ink pad 6. The ink supply tube 21 provided in the ink tank 2 is coupled to the ink absorber/retainer member 3 on its side. With the elastic member 7 being interposed on top of the inner casing 1 between the inner and outer casing, the outer casing 4 is fitted on the inner casing 1 into a single assembly so that the fixed axle 52 is fitted in the mounting apertures 41 provided in the outer casing 4.

At that time, the distal open of the ink supply tube 21 is press fitted in the absorbent member 31 so as to convert it to intrinsic use as the ink absorber/retainer member 3 in the vicinity of the distal open end of the ink supply tube 21. The ink supply tube 21 may have its distal open end press fitted in the absorbent member 31 in any direction; that is, top down or sideways, as desired.

In this embodiment, the term 'to fit/to be fitted' means that the ink supply tube 21 and the ink absorber/retainer member 3 are connected together; specifically herein, press fitting is preferable to couple and connect the ink supply tube 21 with the ink absorber/retainer member 3. Press fitting is applying pressure to one piece of component to put it in contact with another piece of component; for instance, the ink supply tube 21 is forced to fit in the absorbent member 31. Resultantly, the absorbent member 31 and the ink supply tube 21 are press fitted by frictional force developed between fiber bundle of the absorbent member and the outer circumferential surface of the ink supply tube 21.

The twelfth embodiment of the present invention has a structure as mentioned above, and hereinafter, its functions will be described in detail.

A mechanism of ink supply from the ink supply tube 21 to the ink absorber/retainer member 3 will be discussed below.

The ink supply tube 21 or each of the ink supply tubes 21 serves to deliver the ink within the ink tank 2 into the ink absorber/retainer member 3 and also to supply the ink tank 2 with the atmospheric air. As to delivering the ink from the ink tank 2 into the ink absorber/retainer member 3, when the primary ink stamp member has its bottom side down, gravitational force makes the ink in the ink tank 2 pass through the ink supply tube 21 or at least one of the ink supply tubes 21 to the ink absorber/retainer member 3. Simultaneously, the atmospheric air passes through the ink supply tube 21 into the ink tank 2. Thus, the ink absorber/retainer member 3 is impregnated with the ink from the ink tank 2, and the ink impregnating the ink absorber/retainer member 3 is continually delivered to the distal open end of the ink supply tube 21 through which the atmospheric air is taken in.

When the ink impregnating the ink absorber/retainer member 3 reaches the distal open end of the ink supply tube 21 that has served as an external air supply tube, the distal open end of the ink supply tube 21 is blocked by the ink and turned to be airtight, which causes atmospheric air supply into the ink tank 2 to be interrupted. This, in turn, causes the ink supply tube 21 having supplied ink so far to interrupt ink supply from the ink tank 2 to the ink absorber/retainer member 3.

In this way, ink flow from the ink tank 2 and air flow into the same (that is, replacement of the ink with the atmospheric air) is interrupted, the ink tank 2 gets temporarily hermetically sealed.

Impressing mark successively with the ink stamp in this manner, the ink pad in which ink has been consumed is replenished with ink delivered through the ink outlet 3*a* provided in the ink absorber/retainer member 3. The ink that has been supplied from the ink absorber/retainer member 3 to the ink pad 6 is replaced with the ink from the ink tank 2 through the ink supply tube 21, and the user can continue to impress mark till he or she completely uses up the ink in the ink tank 2.

The single ink supply tube 21 may be enough to serve to supply ink from the ink tank 2 into the ink absorber/retainer member 3 and to serve to supply the ink tank 2 with the atmospheric air.

When the atmospheric temperature changes while the ink tank 2 is hermetically sealed, the pressure inside the ink tank 2 accordingly changes. When the atmospheric temperature rises from a temperature level while the ink tank 2 is hermetically sealed, the air within the ink tank 2 expands to cause the internal pressure to rise, which results in ink being ejected out of the ink supply tube 21. Since the ink ejected out is absorbed into the absorbent member 31 that has the air outlet 31*a* and is conductive to the atmospheric air, the ink would not move to the ink pad.

Under the circumstances, when the external temperature goes down, the pressure inside the ink tank 2 accordingly reduces, and the ink that has been ejected is sucked back into the ink supply tube 21.

Reverse to the previously mentioned situation, when the atmospheric temperature goes down from a temperature level while the ink tank 2 is hermetically sealed, the air inside the ink tank 2 is compressed to reduce the internal pressure, and this causes the ink supply tube 21 to suck back the ink in the vicinity of its open end. Under the circumstances, when the atmospheric temperature goes up, the pressure inside the ink tank 2 accordingly rises, the ink that has been sucked up is ejected from the ink supply tube 21.

When the ink tank 2 is replenished with ink, first the outer casing 4 is removed to take out the ink tank 2, which then is to be replaced with new one.

A thirteenth embodiment of the present invention will be described in detail with reference to FIG. 33. Hereinafter, differences from the previous embodiments alone will be discussed.

In this embodiment, the ink supply tube 21 is located on either of lateral sides of the ink absorber/retainer member 3, and the ink supply tube 21 has its distal open end coupled to the side of the ink absorber/retainer member 3.

In one method of assembling them, the distal open end of the ink supply tube 21 is press fitted in the side of the absorbent member 31 so as to convert it to intrinsic use as the ink absorber/retainer member 3 in the vicinity of the ink supply tube 21, resulting in the distal open end of the ink supply tube 21 being coupled with the ink absorber/retainer member 3.

Figure 34:
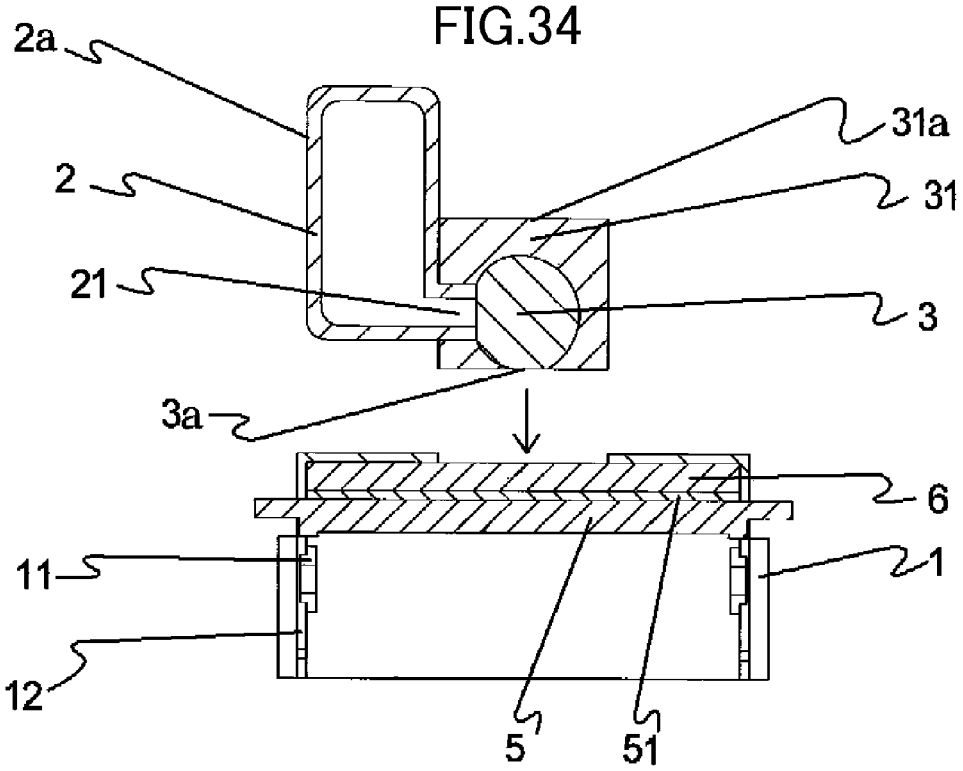
FIG. 34 is a diagram showing an ink tank of the thirteenth embodiment being attached.

Alternatively, as can be seen in FIG. 34, when replenished with ink, the ink tank 2 is first removed to replace with new one, and at this time, the ink absorber/retainer member 3 and the absorbent member 31 may also be removed to replace with their respective new ones.

The thirteenth embodiment of the present invention has a structure as mentioned above, and it is similar to the twelfth embodiment except that the ink supply tube 21 is coupled to the side of the ink absorber/retainer member 3.

Figure 35:
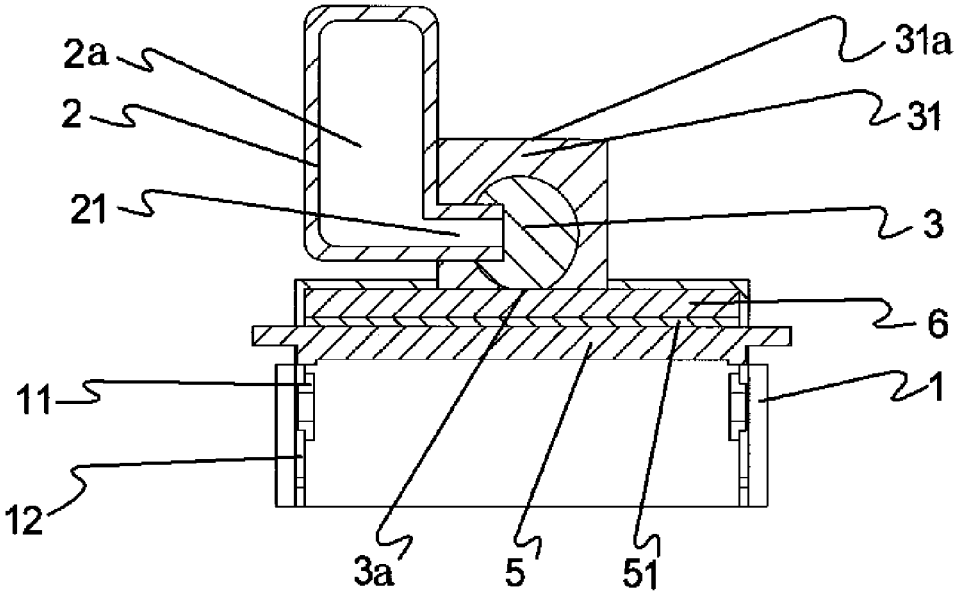
FIG. 35 is a diagram of a fourteenth embodiment of the present invention.

A fourteenth embodiment of the present invention will be described in detail with reference to FIG. 35. Hereinafter, differences from the previous embodiments alone will be discussed.

In this embodiment, the ink supply tube 21 is located on either of laterally opposite sides of the ink absorber/retainer member 3, and the ink supply tube 21 has its distal open end fitted to an inner portion of the ink absorber/retainer member 3.

In one method of assembling them, which is similar to the previous embodiment where the distal open end of the ink supply tube 21 is press fitted in the side of the absorbent member 31 so as to convert it to intrinsic use as the ink absorber/retainer member 3 in the vicinity of the ink supply tube 21, the distal open end of the ink supply tube 21 is strongly press fitted to the ink absorber/retainer member 3 so as to reach deeper inside.

The fourteenth embodiment of the present invention has a structure as mentioned above, and it is similar to the twelfth and thirteenth embodiments except that the ink supply tube 21 has its distal open end coupled to the inner portion of the ink absorber/retainer member 3. In this embodiment, since the distal open end of the ink supply tube 21 reaches to couple with the inner portion of the ink absorber/retainer member 3, a more secure connected of the ink supply tube 21 with the ink absorber/retainer member 3 can be obtained.

Figure 36:
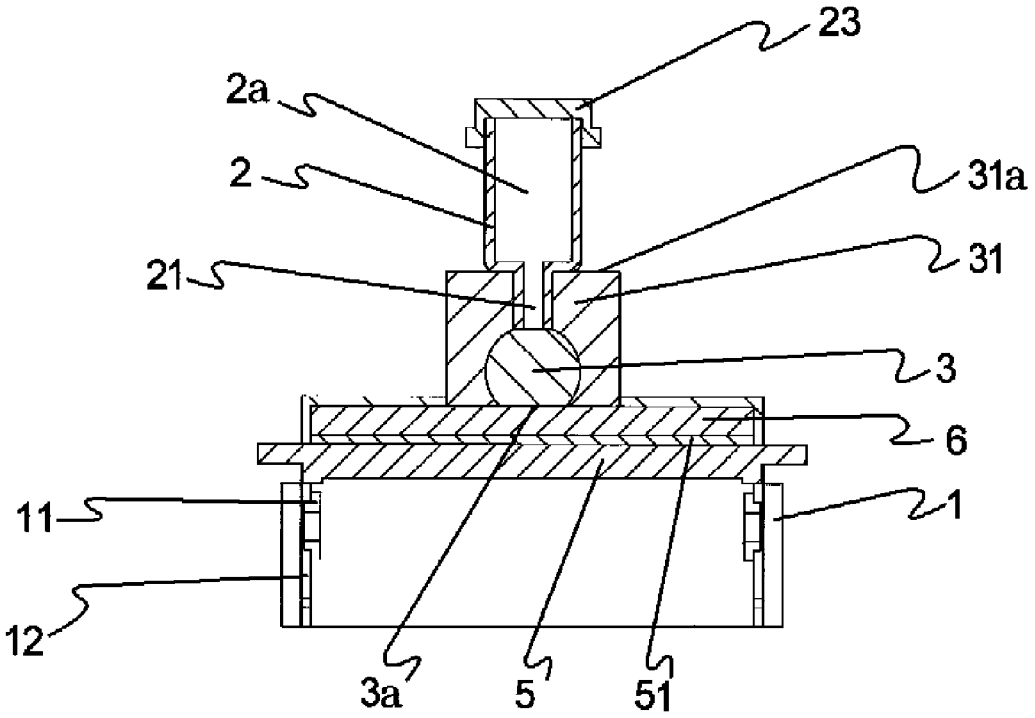
FIG. 36 is a diagram showing a fifteenth embodiment of the present invention.
Figure 37:
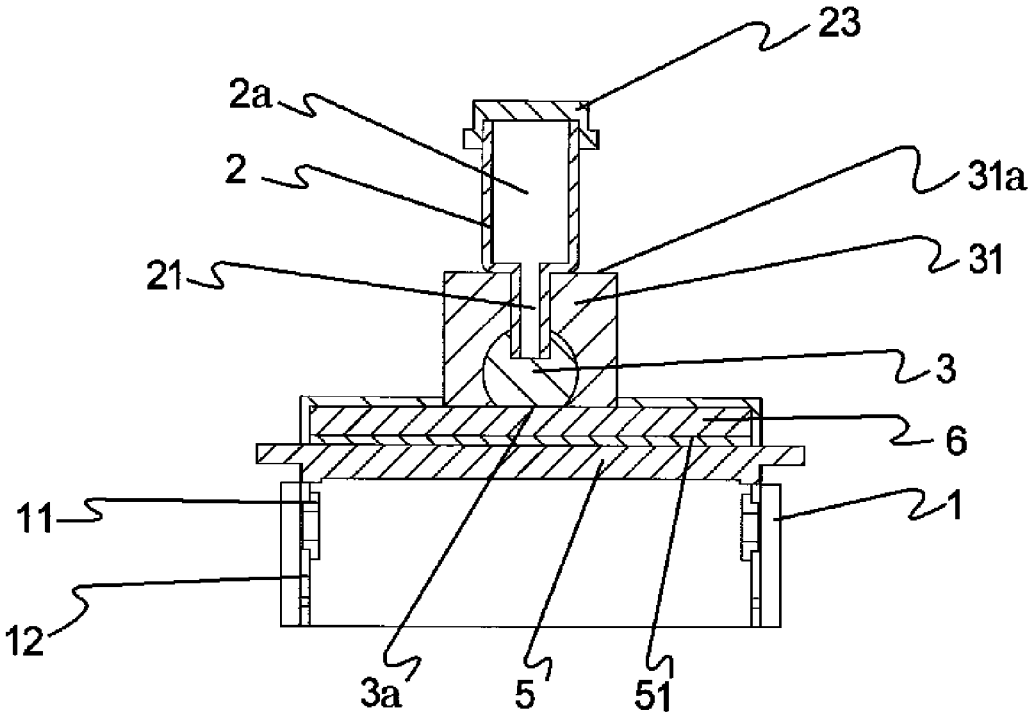
FIG. 37 is a diagram showing a sixteenth embodiment of the present invention.
Figure 38:
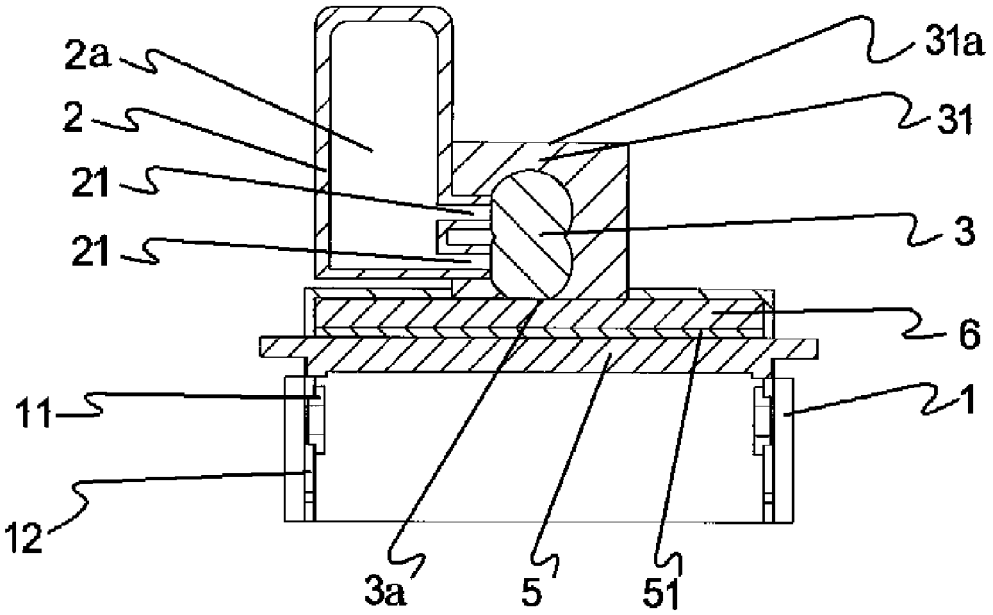
FIG. 38 is a diagram showing a seventeenth embodiment of the present invention.

A fifteenth embodiment of the present invention will be described in detail with reference to FIG. 36. Hereinafter, differences from the previous embodiments alone will be discussed.

In this embodiment, the ink supply tube 21 is disposed on top of the ink absorber/retainer member 3, and the ink supply tube 21 has its distal open end coupled to the upper major surface of the ink absorber/retainer member 3.

In one method of assembling them, the distal open end of the ink supply tube 21 is press fitted in the absorbent member 31 on the top down basis so as to convert it to intrinsic use as the ink absorber/retainer member 3 in the vicinity of the ink supply tube 21.

The fifteenth embodiment of the present invention has a structure as mentioned above, and it is similar to the twelfth and thirteenth embodiments except that the distal open end of the ink supply tube 21 is coupled to the top of the ink absorber/retainer member 3.

A sixteenth embodiment of the present invention will be described in detail with reference to FIG. 7. Hereinafter, differences from the previous embodiments alone will be discussed.

In this embodiment, the ink supply tube 21 is disposed don top of the ink absorber/retainer member 3, and the ink supply tube 21 has its distal open end coupled with an inner portion of the ink absorber/retainer member 3.

In one method of assembling them, which is similar to the previous embodiment where the distal open end of the ink supply tube 21 is press fitted to the upper major surface of the absorbent member 31 so as to convert it to intrinsic use as the ink absorber/retainer member 3 in the vicinity of the ink supply tube 21, the distal open end of the ink supply tube 21 is strongly press fitted to the ink absorber/retainer member 3 so as to reach deeper inside.

The sixteenth embodiment of the present invention has a structure as mentioned above, and it is similar to the fifteenth embodiment except that the distal open end of the ink supply tube 21 reaches deeper inside to couple with the ink absorber/retainer member 3. In this embodiment, since the distal open end of the ink supply tube 21 is connected with the inner portion of the ink absorber/retainer member 3, a more secure connection of the ink supply tube 21 with the ink absorber/retainer member 3 can be obtained.

A seventeenth embodiment of the present invention will be described in detail with reference to FIGS. 38 to 43. Hereinafter, differences from the previous embodiments alone will be discussed.

In this embodiment, more than one of the ink supply tubes 21 may be disposed, and a representative case in which there are two of the ink supply tubes 21 will be discussed below. A cross section taken along outer and inner circumferences of each of the ink supply tubes 21 may be in any shape of a circle, an ellipse, and polygons such as a triangle, a rectangle, and the like. The distal open end of each of the ink supply tubes 21 may be directed downward, or otherwise, laterally outward. The distal open end of each of the ink supply tubes 21 may take any of various shapes, including a bevel, a steep or orthogonal surface, a conically curved surface, a convexly curved surface, and so forth.

Figure 39:
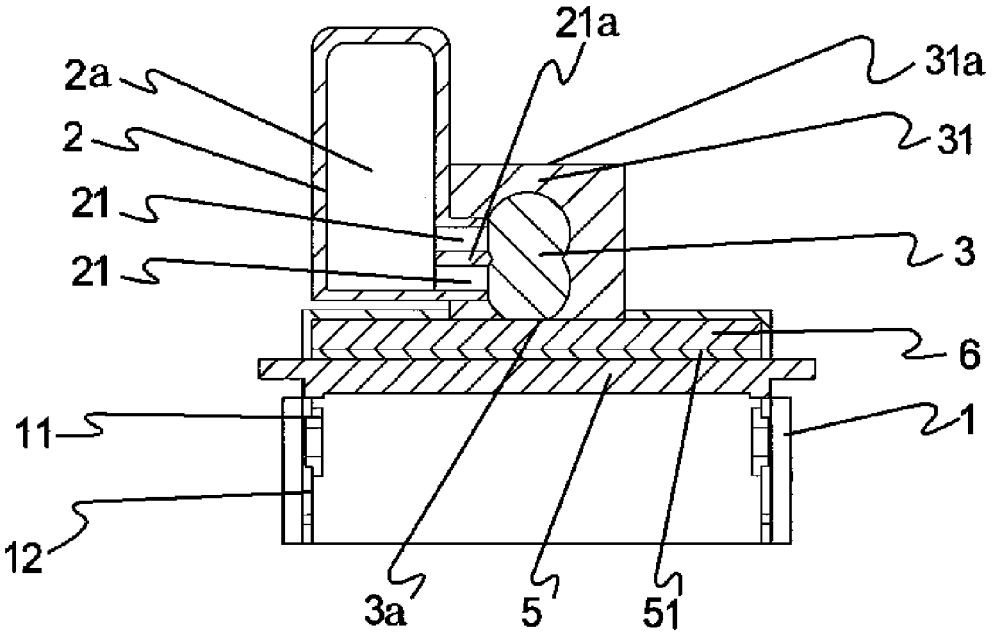
FIG. 39 is a diagram showing an alternative ink supply tube in the seventeenth embodiment.

As shown in FIG. 39, the ink supply tubes 21 may have their respective circumferential walls coupled to each other. Such a manner is just the same as a single tube separated by an axially extended partition wall 21*a* into side-by-side ducts which serve as two independent ink supply tubes 21 in parallel with each other inside the single tube.

Figure 40:
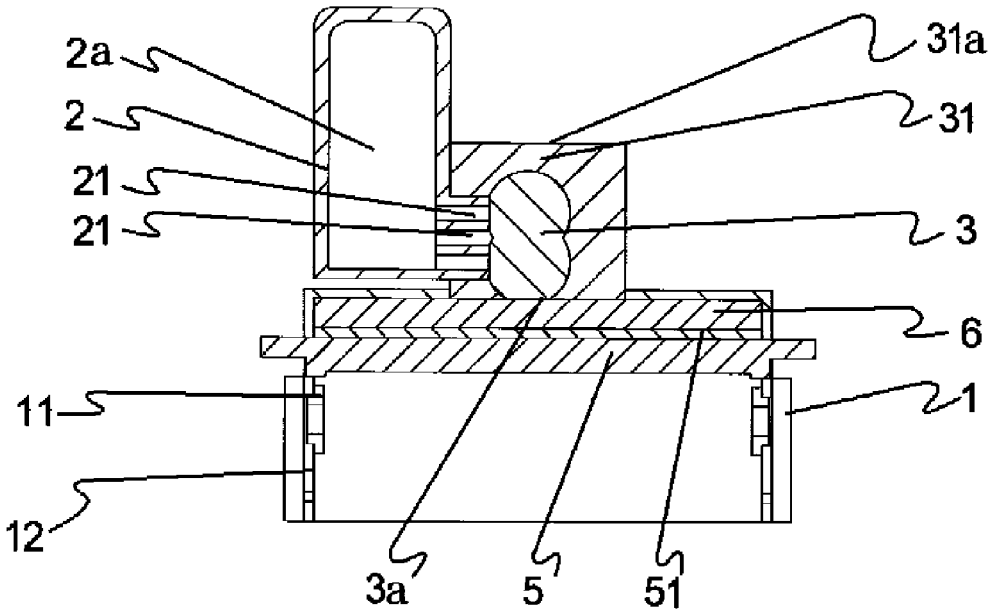
FIG. 40 is a diagram showing another alternative ink supply tube in the seventeenth embodiment.

As can be seen in FIG. 40, two of the ink supply tubes 21 may be disposed so that one smaller in diameter may be located within the other larger in diameter. In such a manner, an inner circumferential surface of the larger ink supply tube 21 together with an outer circumferential surface of the smaller ink supply tube 21 define a channel having an annular cross section, and the smaller ink supply tube 21 provides an inner channel having a circular cross section.

The seventeenth embodiment of the present invention has a structure as mentioned above, and its functions will be described in detail below:

This embodiment is similar to the previous embodiments except that two of the ink supply tubes 21 respectively serve to supply the ink absorber/retainer 3 with ink from the ink tank 2 and to supply the atmospheric air into the ink tank.

Figure 41:
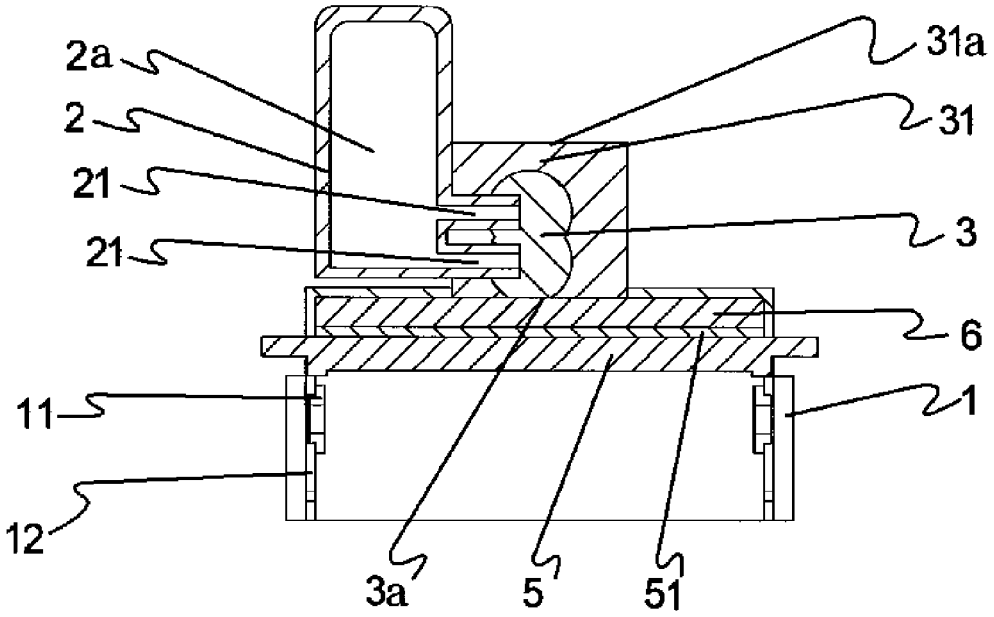
FIG. 41 is a diagram showing a connection method in the seventeenth embodiment.
Figure 42:
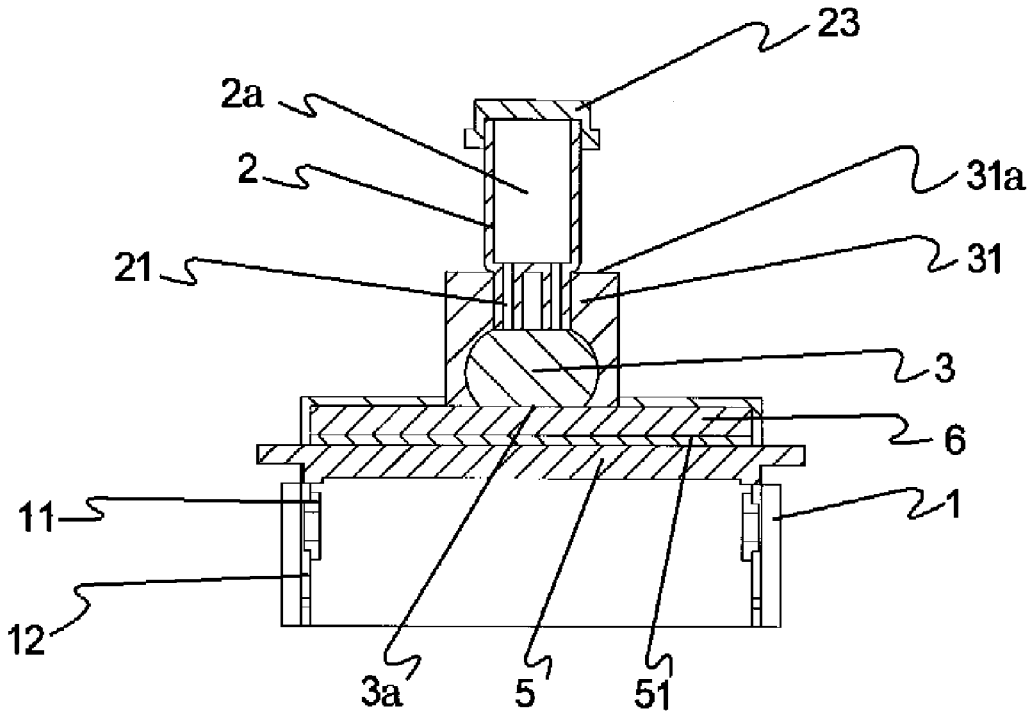
FIG. 42 is a diagram showing an alternative connection method in the seventeenth embodiment.
Figure 43:
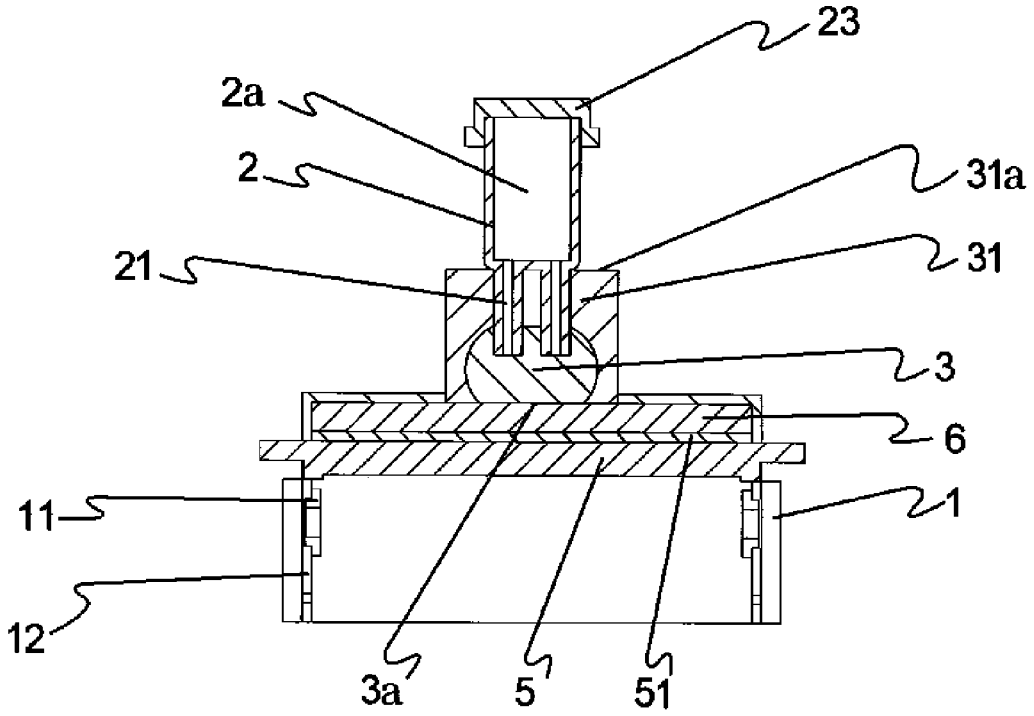
FIG. 43 is a diagram showing another alternative connection method in the seventeenth embodiment.

Modified versions of the seventeenth embodiment in combination with the fourteenth and sixteenth embodiments, respectively, are shown in FIGS. 41 and 43. In these embodiments, since the distal open end of the ink supply tube 21 reaches deeper inside to couple with the ink absorber/retainer member 3, a more secure connection of the ink supply tube 21 with the ink absorber/retainer member 3 can be obtained.

An eighteenth embodiment of the present invention will be described in detail with reference to FIG. 44. Hereinafter, difficulties from the previous embodiments alone will be discussed.

Figure 44:
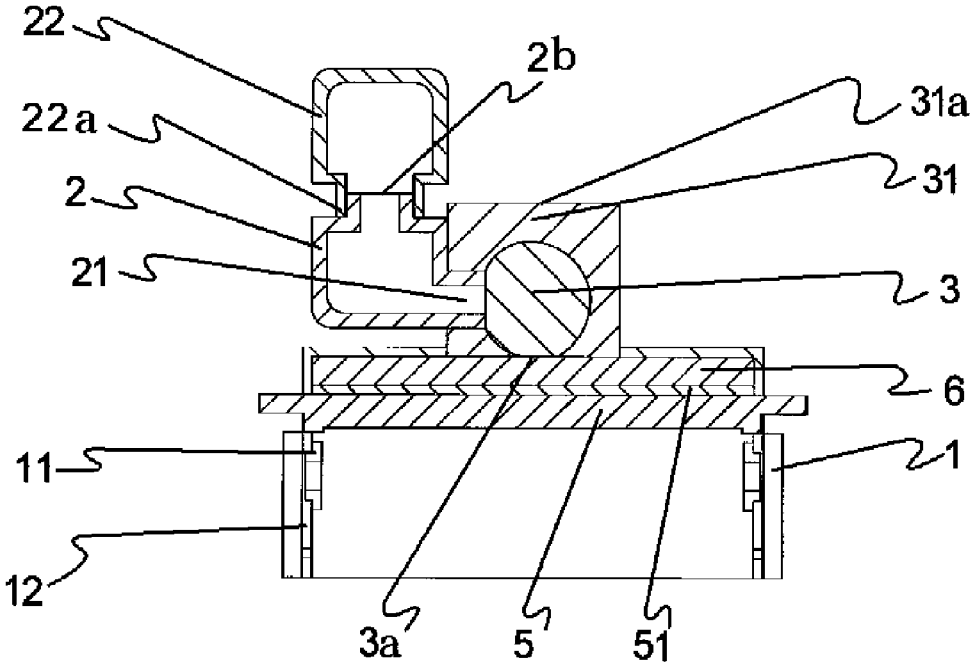
FIG. 44 is a diagram showing an eighteenth embodiment of the present invention.

As depicted in FIG. 44, the attachable/detachable refill ink cartridge 22 may be fitted in the orifice 2*b*. The refill ink cartridge 22 is shaped like an open top cylinder having its one end 22*a* left open, and the open end 22*a* is engaged with the orifice 2*b*. Such engagement of the open end 22*a* with the orifice 2*b* enables the refill ink cartridge 22 to be hermetically sealed. The refill ink cartridge 22, being hermetically sealed in this manner, can prevent ink inside from leaking. The point of the engagement between the open end 22*a* and the orifice 2*b* may be the same as the point along which the refill ink cartridge is sealed, or does not have to be. The engagement is attainable in various ways, including meshing of mating components, pressure fitting, thread fastening, and the like.

The refill ink cartridge 22 in user's custody has the open end 22*a* tightly covered with a cap (not shown), and in use, the cap is removed to fit the refill ink cartridge 22 in the orifice 2*b*. While being attached to the ink tank 2 over the orifice 22*a*, the open end 22*a* of the refill ink cartridge 22 should be upside so as not to spill the ink inside.

The eighteenth embodiment of the present invention has a structure as mentioned above, and its functions will be described in detail below:

When the current refill ink cartridge 22 has to be replaced with new one because it is out of ink, first the current refill ink cartridge 22 is removed from the ink tank 2. During removing the cartridge, the ink tank 2 is still coupled with the absorbent member 31. Then, the new refill ink cartridge 22 is attached to the ink tank 2 by covering the orifice 2*b* with the open end 22*a* of the cartridge.

In order to attach the refill ink cartridge 22, first a cap (not shown) is removed from the open end 22, and thereafter, the open end 22 of the refill ink cartridge 22, which should be upside so as not to spill the ink inside, is fitted in the orifice 2*b* of the ink tank 2.

A nineteenth embodiment of the present invention will now be described in detail with reference to FIGS. 45, 46, and 28. Hereinafter, differences from the previous embodiments alone will be discussed.

Figure 45:
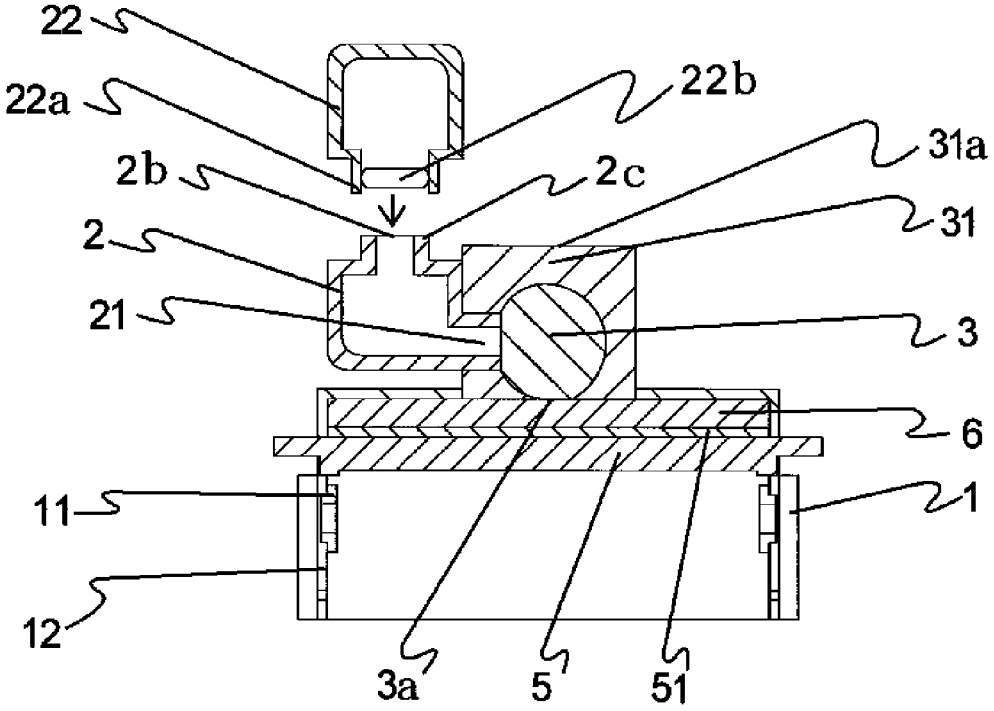
FIG. 45 is a diagram showing a refill ink cartridge being attached in the nineteenth embodiment.
Figure 46:
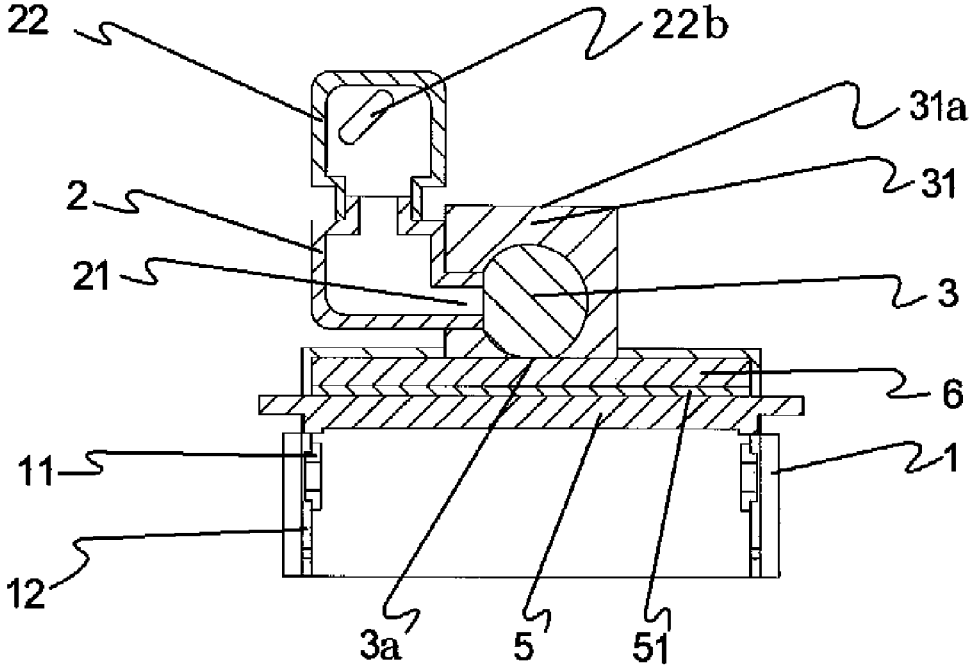
FIG. 46 is a diagram showing the nineteenth embodiment.

As can be seen in FIGS. 45, 46, and 28, a plate-shaped plug 22*b* may be put in the open end 22*a*. The plug 22*b* of the new refill ink cartridge 22 in user's custody is not removed from the open end 22*a* till the new cartridge 22 is attached to the ink tank 2. During attaching it to the ink tank 2, the opener plunger 2*c* on a rim of the ink tank 2 is used to force the plug 22*b* to be pressed up to pop it into the refill ink cartridge 22 itself. Similar to the previous embodiments, the ink tank 2 is also hermetically sealed by the open end 22*a* of the refill ink cartridge 22 engaged with the orifice 2*b*.

In order to avoid an inadvertent leakage of ink, the refill ink cartridge 22 once secured to the ink tank by the hermetical seal of its open end 22*a* over the orifice 2*b* is desirably moved as little as possible to completely pop the plug 22*b* off. The opener plunger 2*c* for pressing the plug may be a bare rim of the ink tank 2, or alternatively, may be a projection(s) specifically provided thereon.

There are a variety of types of the plug 22*b* so as to select one as desired among a ball-shaped plug (FIG. 28A), a lens-shaped plug (FIG. 28B), and so on. The plug 22*b* may be a film or any appropriate kind (not shown) that is rupturable by using the opener plunger 2*c*.

The nineteenth embodiment of the present invention has a structure as mentioned above, and its functions will be described in detail below:

In this embodiment where the plug 22*b* is put in the open end 22*a* of the refill ink cartridge 22, the opener plunger 2*c* is used to press the plug 22*b* to pop it off into the refill ink cartridge so as to open an ink flow path. Thus, since no inadvertent effluent of ink is expected unless the refill ink cartridge is unplugged, the open end 22*a* does not have to be upside, unlike the ninth embodiment. In other words, the open end 22*a* may take any orientation in attaching the refill cartridge 22 to the ink tank 2 on the bottom up, top down, or sideways basis, as desired. When the plug 22*b* is formed of film, it is ruptured by the opener plunger 2*c* to unplug the refill ink cartridge.

A twentieth embodiment of the present invention will be described with reference to FIGS. 47 and 48. Hereinafter, differences from the previous embodiments alone will be discussed.

Figure 47:
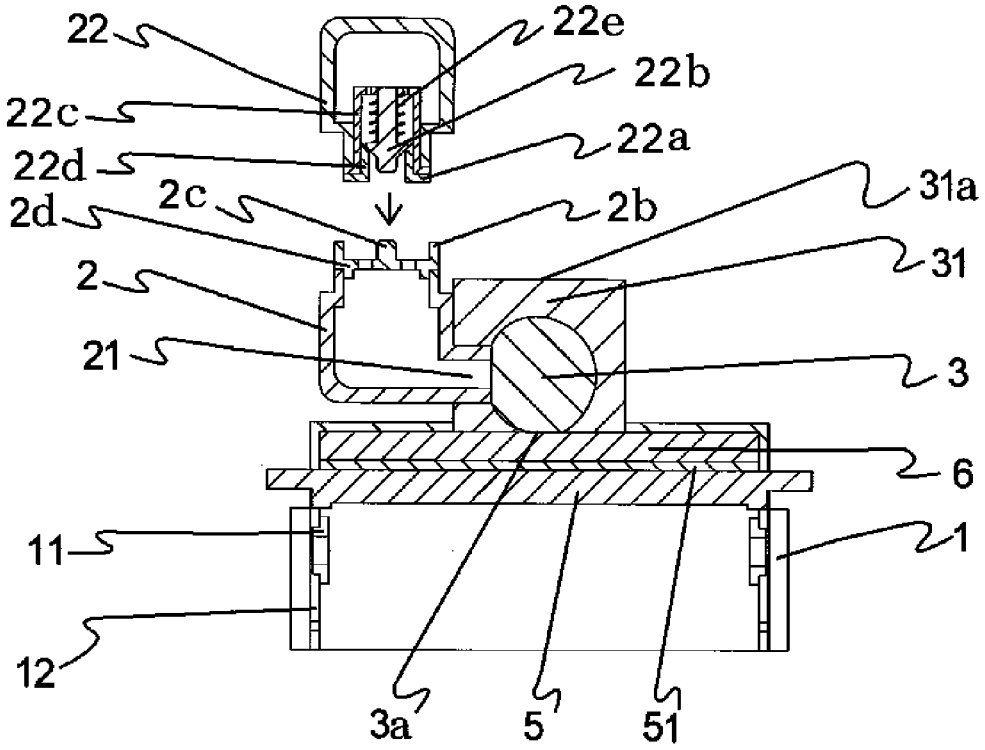
FIG. 47 is a diagram showing a refill ink cartridge being attached in a twentieth embodiment of the present invention.
Figure 48:
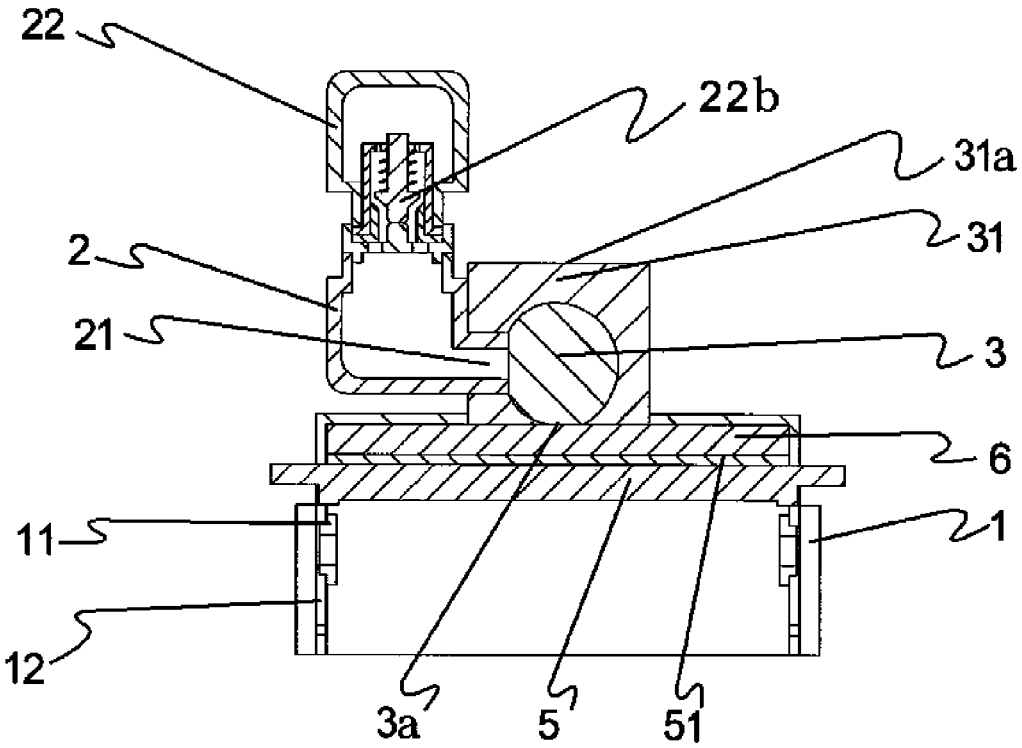
FIG. 48 is a diagram showing the twentieth embodiment.

As depicted in FIGS. 47 and 48, a valve device may be located in the open end 22*a* of the refill ink cartridge 22 as an alternative form to the plug 22*b*, and such a valve device is adapted to open when pushed up by the opener plunger 2*c* and to close when released from the opener plunger 2*c*.

The valve device comprises a cylindrical valve body 22*c*, a valve cap 22*d*, the plug 22*b*, and a coil spring 22*e*. The valve cap 22*d*, which has the plug 22*b* incorporated along with the coil spring 22*e*, is fitted in an opening of the cylindrical valve body 22*c*. Surrounding an ink flow path through the valve cap 22*d*, a valve seat is disposed and engaged with a valve member provided in the plug 22*b*, and usually, elastic force of the coil spring 22*e* pressing the valve member permits it to make an airtight seal with the valve seat.

When pressed up by the opener plunger 2*c*, the plug 22*b* is moved upward against the elastic force of the coil spring 22*e* to release the air tight pressure the valve member applied to the valve seat, which permits the ink inside the refill ink cartridge to flow into the ink tank 2. When released from the upward pressing force by the opener plunger 2*c*, the plug 22*b* exerted by the elastic force of the coil spring 22*e* makes the valve member press on the valve seat for a hermetical seal again to put the plug back in the closed position.

The opener plunger 2*c* may be integrally formed with the ink tank 2, or otherwise, may be separately formed as shown in the drawings. When they are formed in separate units, an inner plug 2*d* is put in the orifice 2*b* and attached to the ink tank 2, and the inner plug 2*d* is provided with the opener plunger 2*c* on top so that a rim of the orifice 2*b* surrounds the opener plunger 2*c*. The open end 22*a* of the refill ink cartridge 22 is detachably fitted in the orifice 2*b*. Similar to the previous embodiments, the ink tank 2 is hermetically sealed at its orifice 2*b* by the open end 22*a* of the refill ink cartridge 22.

The twentieth embodiment of the present invention has a structure as mentioned above, and its functions will be described in detail below:

For the aforementioned valve device of which plug 22*b* is pressed up by the opener plunger 2*c* and has its valve member opened so as to open the ink flow path, there is no restriction on the direction in which the open end 22*a* faces. In other words, the open end 22*a* may take any orientation in attaching it to the ink tank over the orifice on the bottom up, top down, or sideways basis, as desired.

When the current refill ink cartridge 22 is removed from the ink tank 2 in order to replace with a new refill ink cartridge 22, the remnant ink within the current refill ink cartridge 22 is prone to leak out. With the valve device being used, however, the valve member works to close the open end 22*a* during the removal of the current refill ink cartridge from the ink tank, and no ink leakage is caused.

Although the eighteenth to twentieth embodiments have been described in conjunction with the thirteenth embodiment, they may be modifications of the fourteenth to seventeenth embodiments to attain the similar effects. FIGS. 33 to 48 are provided by way of example in which the outer casing 4 is omitted.

Although the present invention has been described in the context of the aforementioned embodiments, it should be understood that the present invention is not limited to them, or rather, a variety of improvements and modifications are contemplated without departing from the true spirit and scope of the present invention.

The invention claimed is:

1. An invertible ink stamp, comprising an inner casing provided with inversion guides inside, an outer casing attached to the inner casing with an elastic element interposed therebetween, a primary ink stamp member having an ink stamp face and invertible by virtue of the inversion guides, an ink pad disposed within the inner casing, an ink absorber/retainer member disposed on top of the ink pad, an absorbent member disposed on the top of the ink absorber/retainer member and having capillary attraction weaker than that of the ink absorber/retainer member but sufficient to absorb excessive ink, the absorbent member having a vent in at least part of the top side or either of lateral sides for conducting to the atmospheric air, an ink tank having an ink supply tube, the ink supply tube having a distal open end connected to the ink absorber/retainer member, and a wall member enclosing the sides of the ink absorber/retainer member, the wall member having an ink outlet at the bottom.

2. The invertible ink stamp according to claim 1, wherein the wall member is an ink-blocking wall member and the bottom of the wall member is in contact with an upper major surface of the ink pad.

3. The invertible ink stamp according to claim 1, wherein the wall member is one of a fiber wall member and a porous wall member weaker in capillary attraction than the ink absorber/retainer member and having air conductivity, and the wall member has its bottom surface in contact with the upper major surface of the ink pad.

4. The invertible ink stamp according to claim 1, wherein the ink supply tube is disposed on either of lateral sides of the ink absorber/retainer member, and the ink supply tube has its distal open end coupled to the ink absorber/retainer member on the side.

5. The invertible ink stamp according to claim 1, wherein the ink supply tube is disposed on either of lateral sides of the ink absorber/retainer member, and the ink supply tube has its distal open end coupled to an inner portion of the ink absorber/retainer member.

6. The invertible ink stamp according to claim 1, wherein the ink supply tube is disposed on either of lateral sides of the ink absorber/retainer member, and the ink supply tube has its distal open end coupled to the ink absorber/retainer member on the top.

7. The invertible ink stamp according to claim 1, wherein the ink supply tube is disposed on top of the ink absorber/retainer member, and the ink supply tube has its distal open end coupled to an inner portion of the ink absorber/retainer member.

8. The invertible ink stamp according to claim 1, wherein the ink supply tube is one of singular and plural in number.

9. The invertible ink stamp according to claim 1, wherein the ink tank has an orifice in an upper major surface, and the invertible ink stamp further includes a refill ink cartridge containing ink and having an open end, the open end of the refill ink cartridge being detachably fit in the orifice of the ink tank for a hermetical seal.

10. The invertible ink stamp according to claim 9, further including a plug removably placed in the open end of the refill ink cartridge, the plug being removable to unplug the open end when the open end is fitted in the orifice of the ink tank.

11. The invertible ink stamp according to claim 10, wherein the plug is placeable in the open end of the refill ink cartridge to plug the open end when the open end is removed from the orifice of the ink tank.

12. The invertible ink stamp according to claim 1, wherein:

the wall member and the absorbent member are made of the same material and formed as one and the distal open end of the ink supply tube is press fit in the absorbent member for converting the distal open end of the ink supply tube to intrinsic use as the ink absorber/retainer member in the vicinity of the distal open end of the ink supply tube.

13. The invertible ink stamp according to claim 12, wherein the ink supply tube has its distal open end press fitted in the absorbent member on either of lateral sides, the ink supply tube being disposed on the side of the ink absorber/retainer member and the distal open end of the ink supply tube being coupled to the ink absorber/retainer member on the side.

14. The invertible ink stamp according to claim 12, wherein the ink supply tube has its distal open end press fitted in the absorbent member on either of lateral sides, the ink supply tube being disposed on the side of the ink absorber/retainer member and the distal open end of the ink supply tube being coupled with the inner portion of the ink absorber/retainer member.

15. The invertible ink stamp according to claim 12, wherein the ink supply tube has its distal open end press fitted in the absorbent member on top, the ink supply tube being disposed on top of the ink absorber/retainer member and the distal open end of the ink supply tube being coupled to the ink absorber/retainer member on top.

16. The invertible ink stamp according to claim 12, wherein the ink supply tube has its distal open end press fitted in the absorbent member on top, the ink supply tube being disposed on top of the ink absorber/retainer member and the distal open end of the ink supply tube being coupled with the inner portion of the ink absorber/retainer member.

17. The invertible ink stamp according to claim 12, wherein the ink supply tube is one of singular and plural in number.

18. The invertible ink stamp according to claim 12, wherein the ink tank has an orifice in an upper major surface, and the invertible ink stamp further includes a refill ink cartridge containing ink and having an open end, the open end of the refill ink cartridge being detachably fit in the orifice of the ink tank for a hermetical seal.

19. The invertible ink stamp according to claim 18, further including a plug removably placed in the open end of the refill ink cartridge, the plug being removable to unplug the open end when the open end is fitted in the orifice of the ink tank.

20. The method according to claim 19, wherein the plug is placeable in the open end of the refill ink cartridge to plug the open end when the open end is removed from the orifice of the ink tank.

* * * * *